US012752156B2

(12) United States Patent
Acosta et al.

(10) Patent No.: US 12,752,156 B2
(45) Date of Patent: Oct. 6, 2026

(54) INDIVIDUALIZED LUNG TRAINERS AND ASSOCIATED METHODS

(71) Applicant: Lung Trainers, LLC, Dania Beach, FL (US)

(72) Inventors: Frank Acosta, Miami, FL (US); William Rose, Miami, FL (US)

( * ) Notice: Subject to any disclaimer, the term of this patent is extended or adjusted under 35 U.S.C. 154(b) by 0 days.

(21) Appl. No.: 18/114,207

(22) Filed: Feb. 24, 2023

(65) Prior Publication Data

US 2024/0286003 A1 Aug. 29, 2024

Related U.S. Application Data

(60) Provisional application No. 63/313,865, filed on Feb. 25, 2022.

(51) Int. Cl.
*A63B 23/18* (2006.01)

(52) U.S. Cl.
CPC ..... *A63B 23/18* (2013.01)

(58) Field of Classification Search
CPC ..... A63B 23/18; A63B 23/185
See application file for complete search history.

(56) References Cited

U.S. PATENT DOCUMENTS 2,233,507 A * 3/1941 Adamson ..... G10D 7/063 984/132
2,635,387 A * 4/1953 Anderson ..... A63H 27/10 446/221
2,737,074 A * 3/1956 Magnus ..... G10D 7/063 84/375
3,333,844 A * 8/1967 Jurschak ..... A63B 23/18 137/533.27
3,749,083 A * 7/1973 Mathes, Jr. ..... A61F 11/00 285/379
3,805,442 A * 4/1974 Matlack ..... A63B 23/18 446/186
3,949,984 A * 4/1976 Navara ..... A63B 23/18 482/13
4,403,616 A * 9/1983 King ..... A63B 23/18 482/13
5,165,393 A * 11/1992 Kawaguchi ..... A63H 27/10 482/13
5,651,402 A * 7/1997 McCaul ..... A63H 27/10 141/97
6,634,394 B1 * 10/2003 Nelson ..... A63H 27/10 141/97
9,561,399 B2 * 2/2017 Acosta ..... A63B 21/0085
10,086,230 B2 * 10/2018 Acosta ..... A63B 21/00061
10,722,748 B1 * 7/2020 Acosta ..... A63B 21/06
10,814,239 B1 * 10/2020 Allard ..... A63H 27/10
2002/0115533 A1 * 8/2002 Horstel ..... A63B 23/032 482/13
2017/0157462 A1 * 6/2017 Acosta ..... A63B 21/00061
2017/0282088 A1 * 10/2017 Mowbray ..... A63H 27/10

* cited by examiner

*Primary Examiner* — Nyca T Nguyen
(74) *Attorney, Agent, or Firm* — Assouline & Berlowe; Peter A. Koziol, Esq.

(57) ABSTRACT

Lung, diaphragm and surrounding muscles/areas of the anatomy instrument training devices using regulators, tubes, check valves and water redirection channels to improve durability and sanitary functions of the devices, including low-cost disposable alternatives using balloons in place of actual and virtual weighted inserts, including specific methods of training designed for musicians, athletes and other persons that train their lungs.

3 Claims, 24 Drawing Sheets

| Conventional breathing exercise | Lung Trainer |
|---|---|
| Simple breathing<br>• Breath in for 4 beats, out for 4 beats<br>• Breath in for 4 beats, out for 8 beats<br>• Continue to increase exercise | Use the Lung Trainer instrument guide<br>• Use the Lung Trainer's rest monitor to begin your exercise<br>• Using 1 insert, breath in for 4 counts,<br>• Using the breathing monitor, exhale for 4 counts<br>• Breath in for 4, out for 8,12,16, …<br>• Vary by changing breathing in time to 2, 1, etc. |
| Stick it to the wall<br>• Blow a piece of paper against the wall<br>• Hold it up with your breath as long as you can | Use the Lung Trainer instrument breathing guide<br>• Set up your Lung Trainer to match the PSI level of the instrument<br>• Determine the air flow needed<br>• Use the digital display to monitor your progress |
| "The sipping exercise<br>• Breath in for 'X' beats<br>• Hold your breath<br>• Take an additional '2' sips<br>• Breath out for 'X' beats | Increase the amount of inserts in the chamber<br>• Determine your goal<br>• Use the Lung Trainer's rest monitor to begin your exercise<br>• Breath in for 'X' beats<br>• Take '2' sips<br>• Using the breathing monitor, breath out the desired amount of beats<br>• Vary the exercise by adjusting the PSI (using the LED lights) and air flow (changing the number of open holes on the air regulator) |

FIG. 21

| Conventional breathing exercise | Lung Trainer |
|---|---|
| The Pinwheel<br>• Secure a pinwheel<br>• Take a breath and blow on the pinwheel<br>• Use a stopwatch to monitor time | Place one insert in the chamber<br>• Open all holes on the air regulator to force total air flow<br>• Use the instrument breathing guide to find your required<br>• Use the Director's rest monitor to begin your exercise<br>• Inhale, then Exhale into the chamber, adjusting PSI and air flow as necessary |
| Hand on stomach (core area)<br>• Place hand(s) on belly<br>• Breath in deeply<br>• Feel your finger expand around your stomach | Depending on your instrument<br>• The Lung Trainer's technology reinforces 'belly' or core breathing<br>• Use any number of inserts in the chamber<br>• Inhale, then Exhale into the chamber<br>• Feel your diaphragm perform correctly as you keep the inserts moving in the chamber |
| Stand against the wall<br>• This exercise is similar to above<br>• The exercise can also be varied to include counting inhalation and exhalation | The Lung Trainer can be utilized in a sitting or seated position with positive results.<br>Proper posture is encouraged as the Lung Trainer makes the user use core breathing. No chest breathing allowed here. |

FIG. 22

| Name or ID | Baseline with small hole open | First measured assessment | Final measured assessment |
|---|---|---|---|
| 1-Flute | 10 | 22 | 34 |
| 2-Oboe | n/a | | |
| 3-Clarinet | 10 | 17 | 35 |
| 4- Alto Sax | 12 | 21 | 35 |
| 5-Trumpet | 16 | 22 | 30 |
| 6-Trombone | 13 | 14 | 34 |
| 7-Tuba | 24 | 26 | 34 |
| 8-Voice | n/a | | |

FIG. 23

| Instrument | Air pressure | Air flow |
|---|---|---|
| Clarinet | .29-.65 | High |
| Flute | .03-.36 | High |
| Oboe | .53-1.74 | Low |
| Saxophone | .29-1.16 | Moderate |
| Trumpet | .87-3.6 | Low |
| Voice | .5 | High |
| Bassoon | .17-1.28 | Low |
| Trombone/Euphonium | | Moderate |
| Tuba | .25- .62 | High |

FIG. 24

INDIVIDUALIZED LUNG TRAINERS AND ASSOCIATED METHODS

A portion of the disclosure of this patent document contains material which is subject to copyright protection. The copyright owner has no objection to the facsimile reproduction by anyone of the patent document or the patent disclosure, as it appears in the United States Patent and Trademark Office patent file or records, but otherwise reserves all copyright rights whatsoever.

CROSS-REFERENCE TO RELATED APPLICATIONS

This patent application claims the benefit under 35 U.S.C. § 119(e) of U.S. Provisional Patent Application No. 63/313,865 titled Lung Trainers and Associated Methods filed on Feb. 25, 2022 by Frank Acosta and William Rose which application is incorporated herein by reference.

FIELD OF THE INVENTION

The invention broadly relates to lung exercises, more specifically to a device to strengthen lungs, the diaphragm, surrounding muscles/areas of the anatomy and increase lung control and capacity, and even more particularly to a method to strengthen lungs, diaphragms, and surrounding muscles/areas of the anatomy and increase lung control and capacity.

BACKGROUND OF THE INVENTION

Wind instruments are musical instruments that typically include some type of resonator. A column of air is vibrated by a user blowing air into or over a mouthpiece located at the end of a resonator. The pitch of the vibration is determined by the length of the tube in conjunction with modifications of the effective length of the vibrating column of air. In a similar way, vocalists use air to produce pitches. Examples of common wind instruments include horns, trumpets, recorders, flutes, and saxophones.

Musicians playing wind instruments or vocalists require high levels of lung capacity and lung, diaphragm and surrounding muscles/areas of the anatomy control to hit the applicable notes and note lengths while playing a composition. Each wind instrument or voice requires different levels of air regulation and exhaling. Plus, musical compositions vary in difficulty, thereby increasing the lung demand on the musician playing the instrument.

A musician must have the lung, diaphragm, and surrounding muscles/areas of the anatomy control and capacity to breath sufficient air into the instrument to properly play or sing the musical notes and timing required in the musical composition. Although there are a myriad of exercise equipment to exercise a person's muscles or increase their cardiovascular stamina, there has been a need to develop a device and method to increase a person's lung, diaphragm and surrounding muscles/areas of the anatomy strength and capacity.

Often, a new student, without training, can only play certain wind instruments for a limited period of time before they run out of air, i.e. they become "winded." The more the student plays the instrument over time, the student's lung capacity and strength increases due to the training. However, this takes a long time to occur as the training only occurs as the student practices with the instrument. The size of some wind instruments makes playing frequent playing difficult.

Also, some environments do not allow students to practice frequently due to the loud noise emanating from the wind instrument.

There are devices in the market that develop air capacity for users. However, generally these devices do not have a system to train a person's lung, diaphragm and surrounding muscles/areas of the anatomy by regulating weight suspended in air. Moreover, existing devices do not mimic musical instruments for training purposes.

As such, there is a need for lung, diaphragm and surrounding muscles/areas of the anatomy control and capacity training devices and methods that change based on the user's needs. As the user learns to use an instrument or voice and advances to a more complex level, the user needs to increase the user's lung capacity, strength and control. The training requires a calculated system to increase a user's lung capacity, strength and control based on current and future needs.

As can be derived from the variety of devices and methods directed at increasing lung, diaphragm and surrounding muscles/areas of the anatomy strength, capacity and control, many means have been contemplated to accomplish the desired end, i.e., training a user's lungs. Thus, there is a long-felt need for a device and method to aid a user in increasing their lung capacity, strength and control.

The inventors identified herein have created such a device as described in U.S. patent application Ser. No. 14/697,779 incorporated herein by reference in its entirety. That invention provides an elegant device and method of using weighted inserts to measure and control lung, diaphragm and surrounding muscles/areas of the anatomy strength training. However, said invention has been further improved to improve the cost of manufacturing, the durability, sanitary functions and use of the device in medical and therapeutic environments, as well as alternative methods of resistance.

BRIEF SUMMARY OF THE INVENTION

The present inventions broadly include lung trainers with check valves, improved displays, simplified forms, multi-layered housings, water sealing and moisture redirection channels, and disposable low-cost alternative kits.

These and other objects and advantages of the present inventions will be readily appreciable from the following description of preferred embodiments of the inventions and from the accompanying drawings and claims.

BRIEF DESCRIPTION OF THE DRAWINGS

The nature and mode of operation of the present inventions will now be more fully described in the following detailed description of the invention taken with the accompanying drawings.

FIG. 21 is a comparison of conventional breathing exercises and those performed with a Lung Trainer.

FIG. 22 is a comparison of conventional breathing exercises and those performed with a Lung Trainer.

FIG. 23 is an example of baseline measurements and assessments using the Lung Trainer methods.

FIG. 24 is a table of instruments, air pressures and air flows associated with those instruments for use in the Lung Trainer methods and equations.

DETAILED DESCRIPTION OF THE INVENTION

At the outset, it should be appreciated that like drawing numbers on different drawing views identify identical, or functionally similar, structural elements of the inventions. While the present inventions are described with respect to what is presently considered to be the preferred aspects, it is to be understood that the inventions as claimed are not limited to the disclosed aspects.

Furthermore, it is understood that the inventions are not limited to the particular methodology, materials and modifications described and as such may, of course, vary. It is also understood that the terminology used herein is for the purpose of describing particular aspects only, and is not intended to limit the scope of the present inventions, which is limited only by the appended claims.

Unless defined otherwise, all technical and scientific terms used herein have the same meaning as commonly understood to one of ordinary skill in the art to which this invention belongs. It should be appreciated that the term "breathing" is synonymous with terms such as "exhaling", "inhaling", "blowing", "gasping", "puffing", etc., and such terms may be used interchangeably as appearing in the specification and claims. Although any methods, devices or materials similar or equivalent to those described herein can be used in the practice or testing of the inventions, the preferred methods, devices, and materials are now described.

Exercising a user's lungs improves a user's breathing capacity and control. As with swimming and marathon athletes, training improves oxygen intake and the cardiovascular system. The present inventions are preferably used for persons seeking to improve breathing technique and capacity. However, the lung, diaphragm and surrounding muscles/areas of the anatomy instrument training device provides support in numerous fields, including but not limited to, athletics, music, yoga, and medicine. The present inventions also promote greater lung control and strength.

Figure 1:
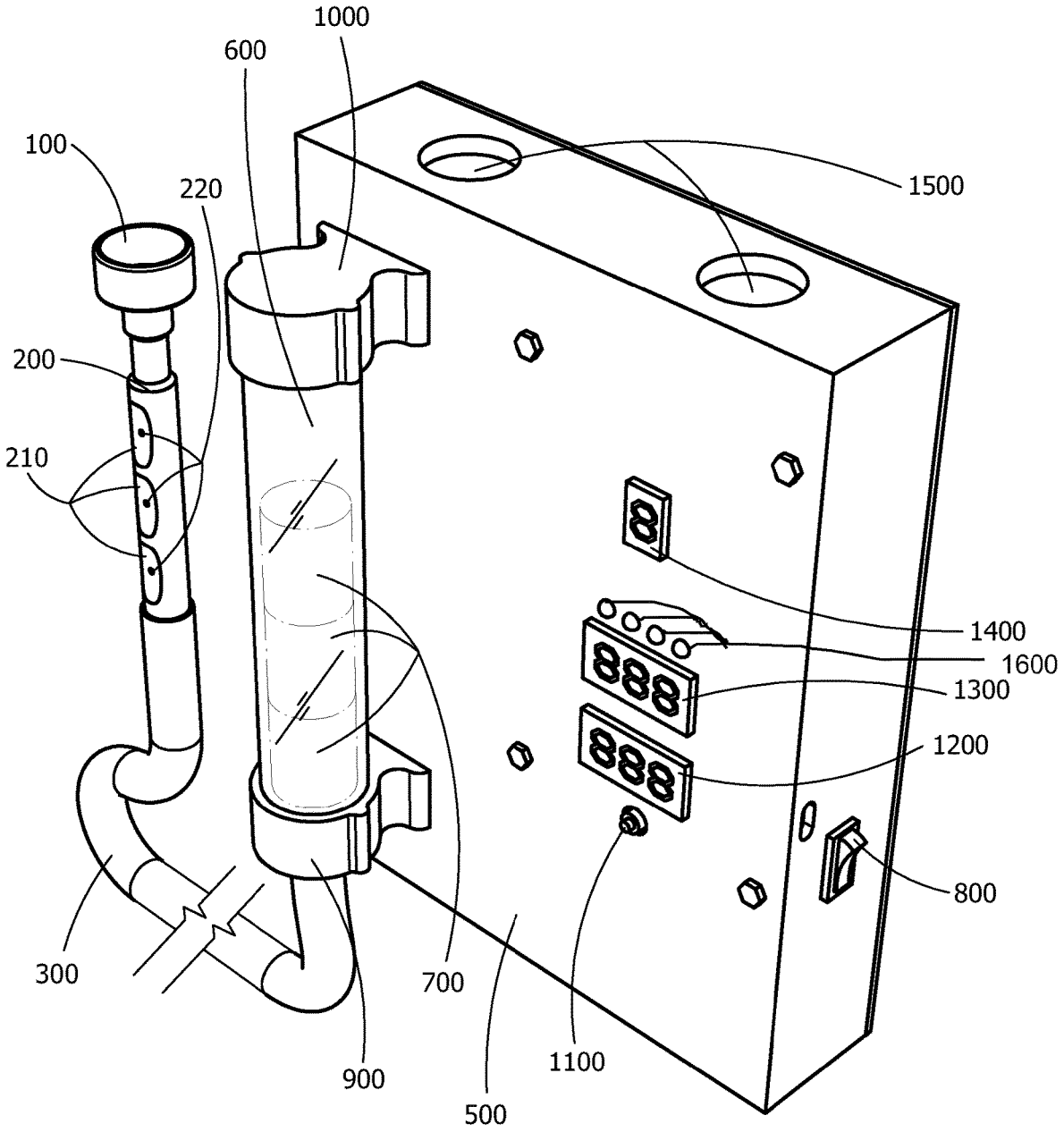
FIG. 1 is a front view of a Lung Trainer.

Adverting now to the Figs., FIG. 1 is a front view of a Lung Trainer. Shown in FIG. 1. are: mouthpiece 100; regulator 200; regulator finger positioner 210; regulator orifice 220; tube 300; lung trainer housing 500; chamber 600; weighted insert 700; switch 800; bottom chamber connection mount 900; upper chamber connection mount 1000; reset button 1100; display 1200; extended display 1300; additional display 1400; weight holders 1500, and, virtual insert indicators 1600. The regulator finger positioners may be used in various arrangements of one or more positioners. Although possible, it is rare that more than eight holes to accommodate each figure is recommended. There may be some applications however where there are 10 or more regulator finger positioner 210 to accommodate thumbs and enable expanded activities. In the exemplary embodiment each regulator finger positioner 210 is associated with a regulator orifice 220. The one or more regulator orifice 220 may vary in size and shape. The larger the hole/aperture of each orifice the greater variations in the regulation of air is provided by that respective orifice. Some applications may utilize regulators where there are orifices with no finger positioners and vice versa finger positioners without orifices. However, to effectively regulate a regulator needs a means to enable the user to vary the amount of air that escapes from the regulator, be it through opening and closing/sealing one or more orifices or providing for adjustable orifices through valves, screws and other means that may be known in the art. Depicted are four virtual insert indicators 1600, however a Lung Trainer may use less or more than four virtual insert indicators 1600. Each virtual insert indicators 1600 may have the same color or vary in colors. For example, the first indicator may be green, the second yellow, the third orange and the fourth red. The indicators may also be replaced with one or more analog or digital pressure gauges. However, to be consistent with the training and methods described herein single indicators are preferred.

Figure 2:
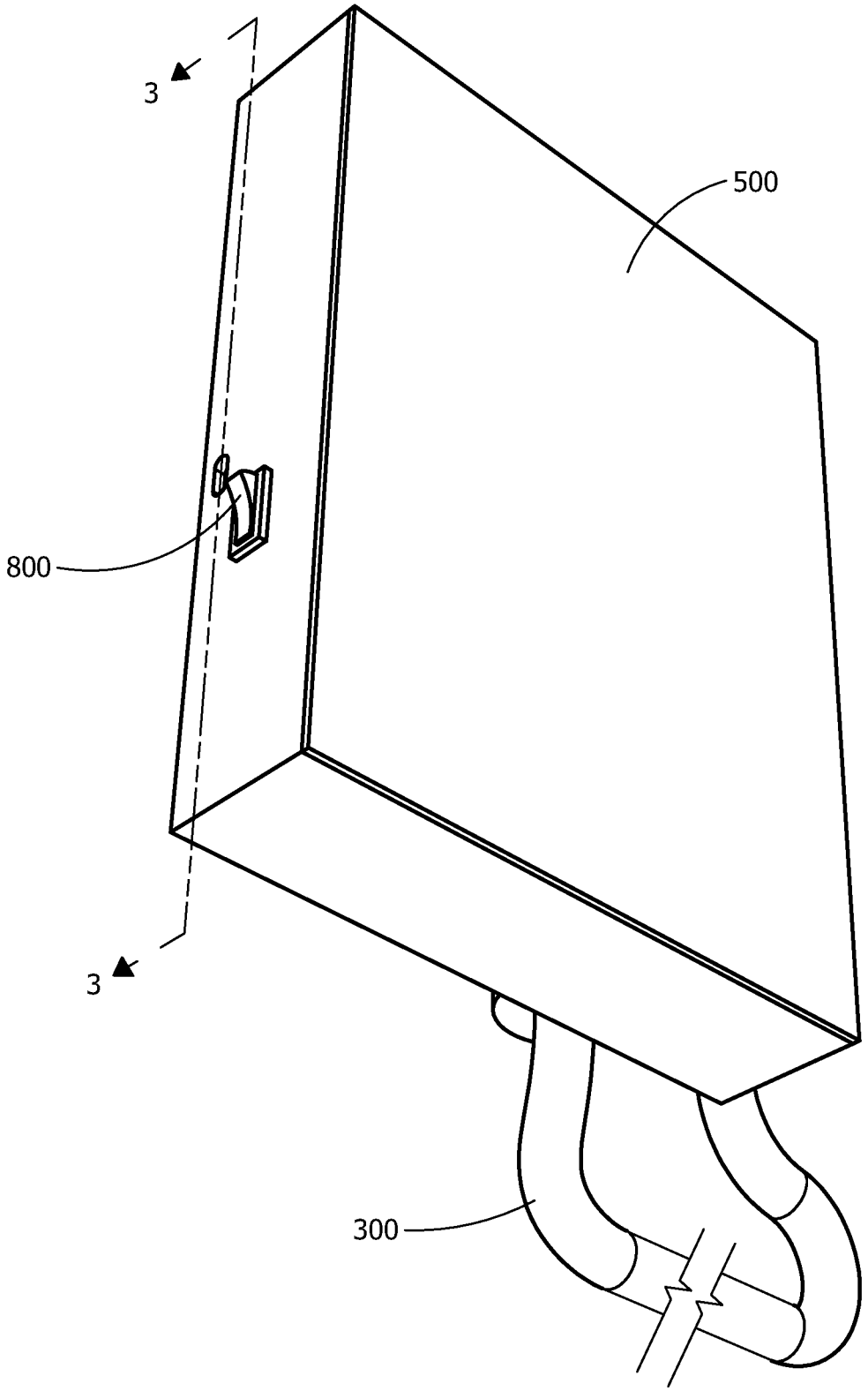
FIG. 2 is a rear view of a Lung Trainer.

FIG. 2 is a rear view of a Lung Trainer. Shown in FIG. 2 are: tube 300; housing 500; and switch 800.

Figure 3:
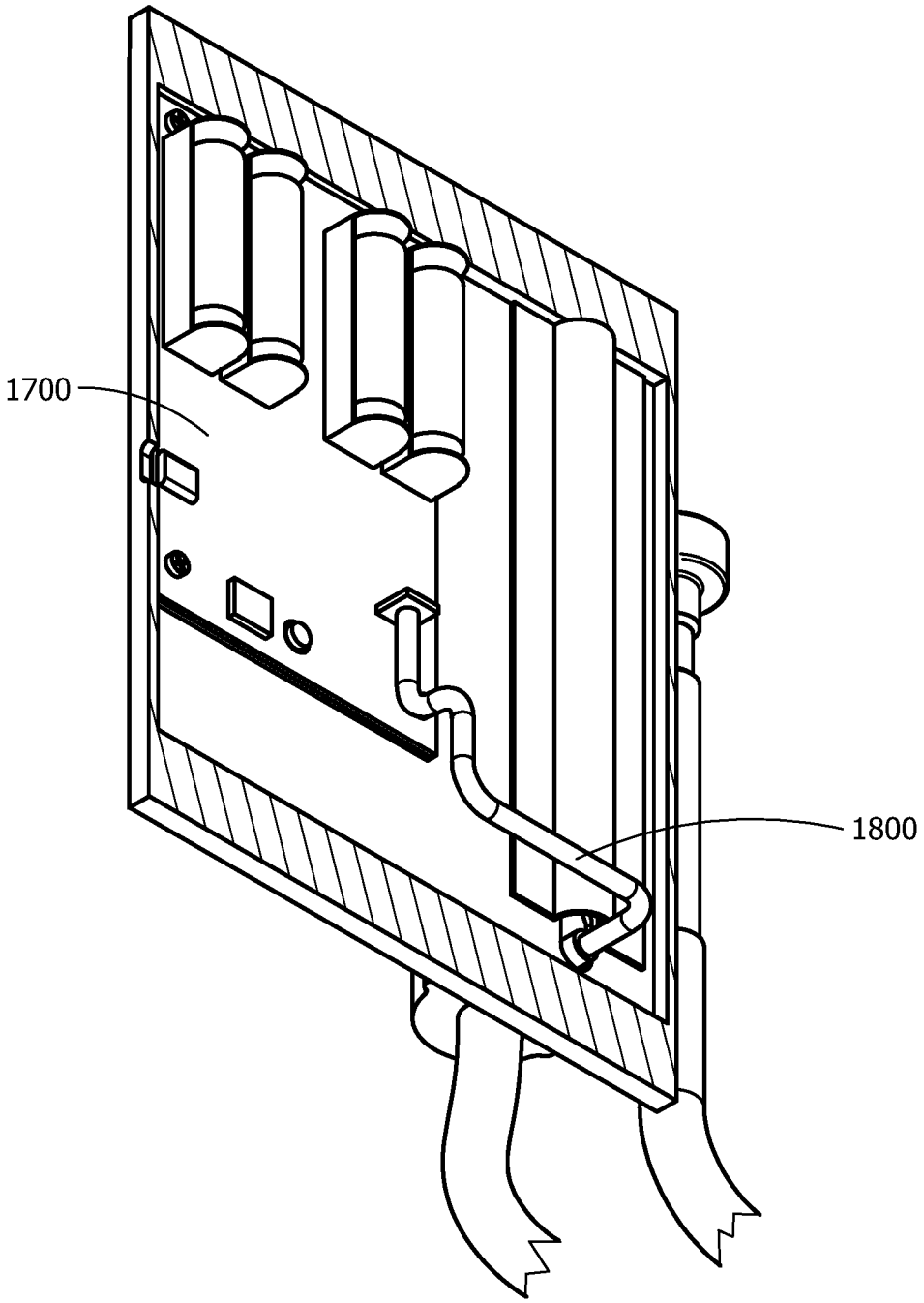
FIG. 3 is a rear view of a Lung Trainer with a back cover removed.
Figure 4:
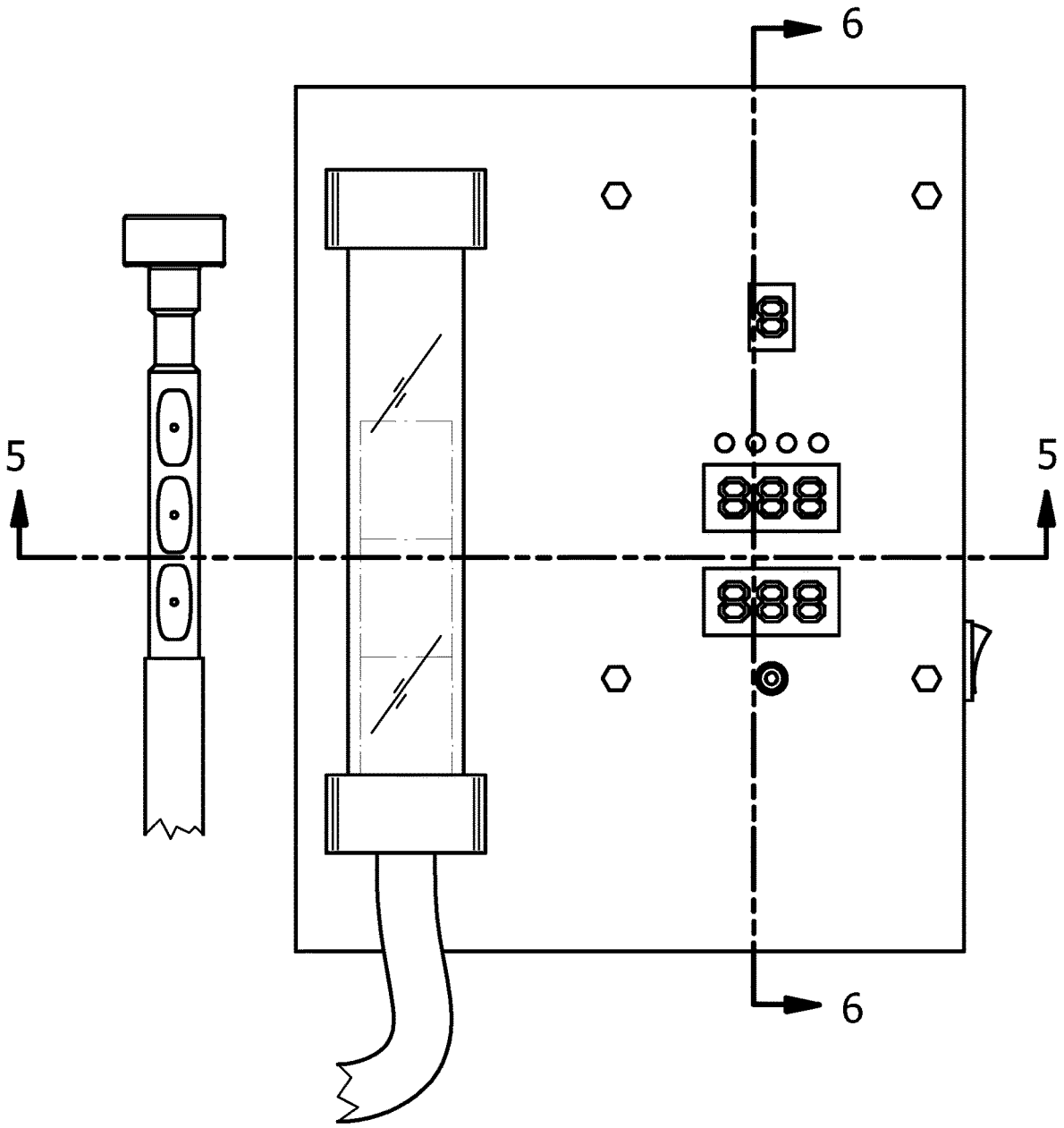
FIG. 4 is a front plan view of a Lung Trainer.
Figure 5:
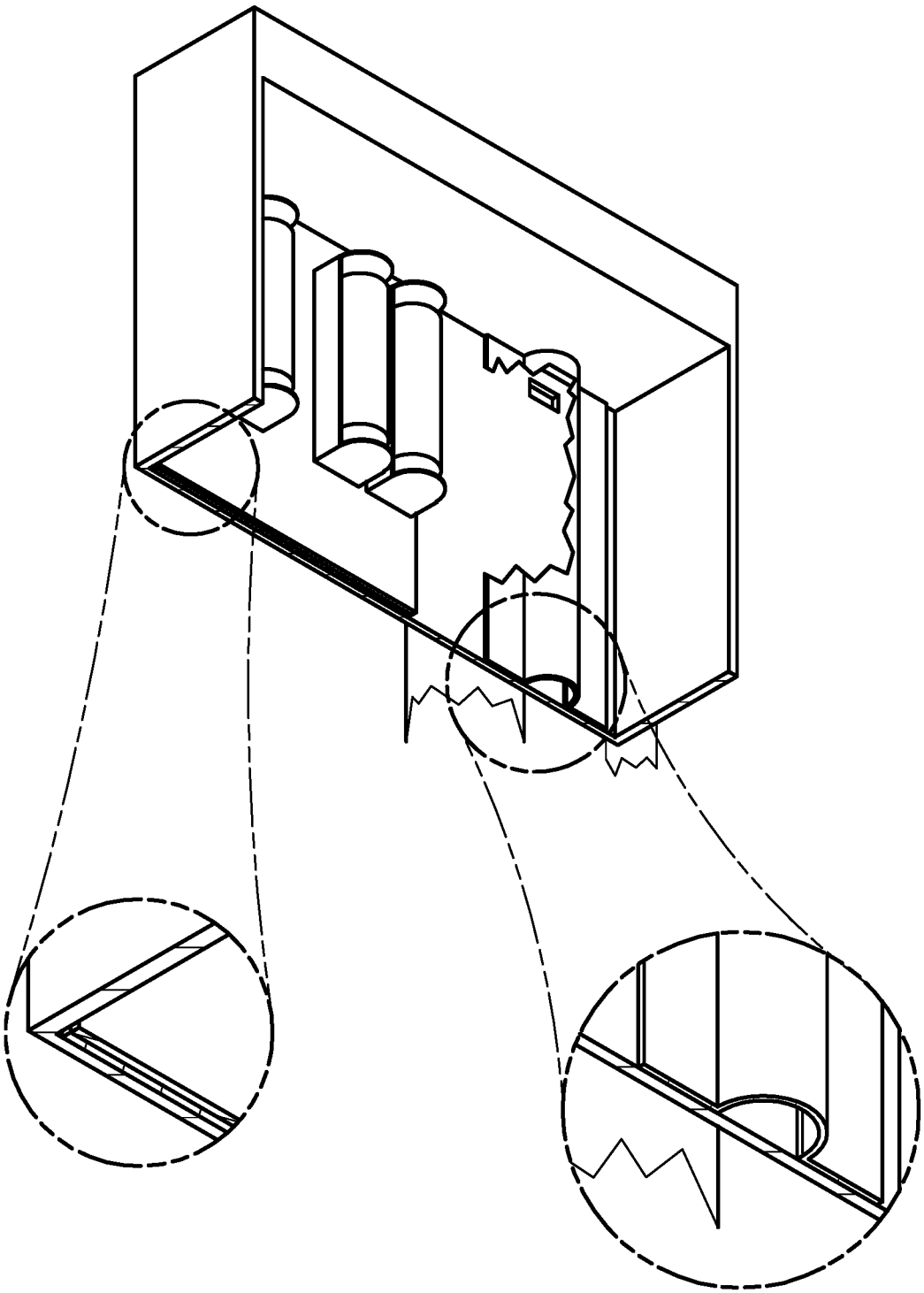
FIG. 5 is a cross sectional view of FIG. 4 taken at line 5.
Figure 6:
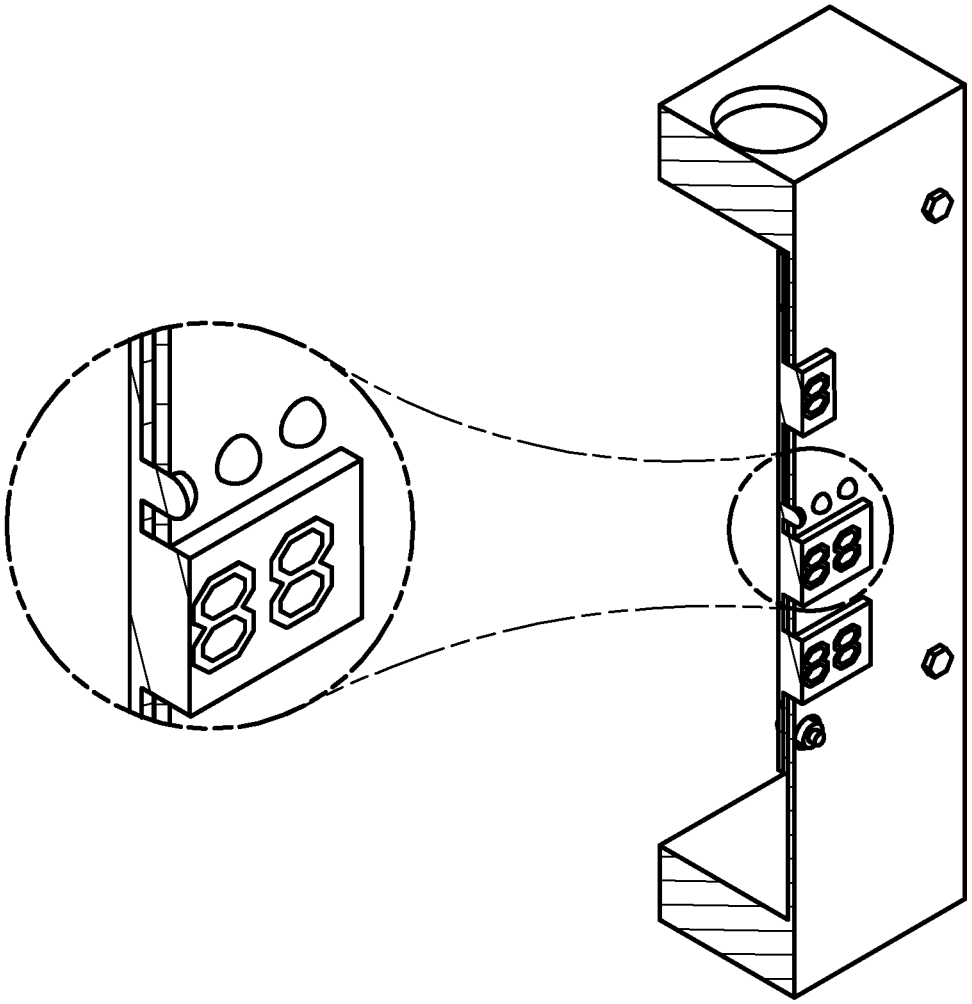
FIG. 6 is a cross sectional view of FIG. 4 taken at line 6.
Figure 7:
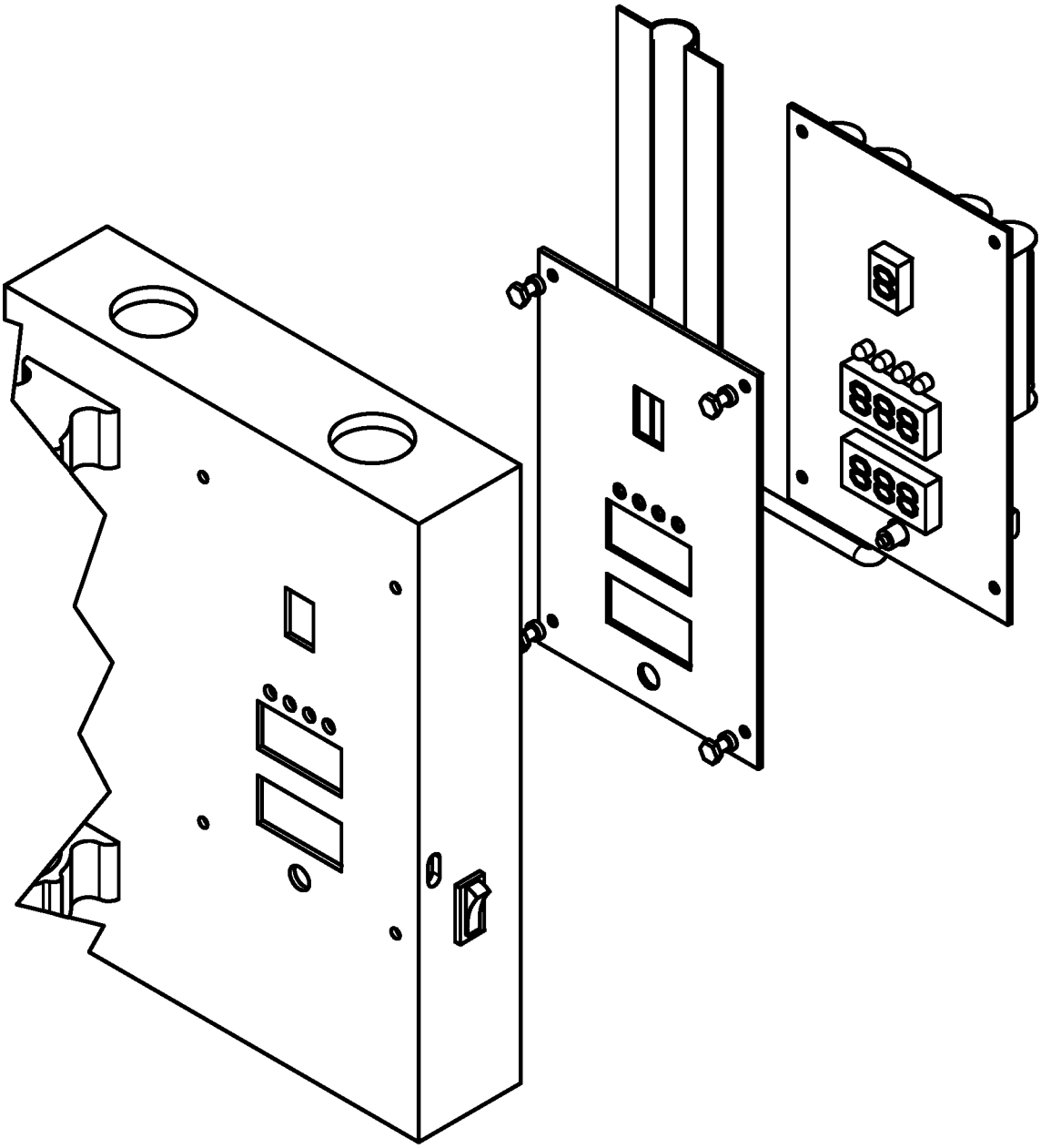
FIG. 7 is an exploded view of a Lung Trainer.
Figure 8:
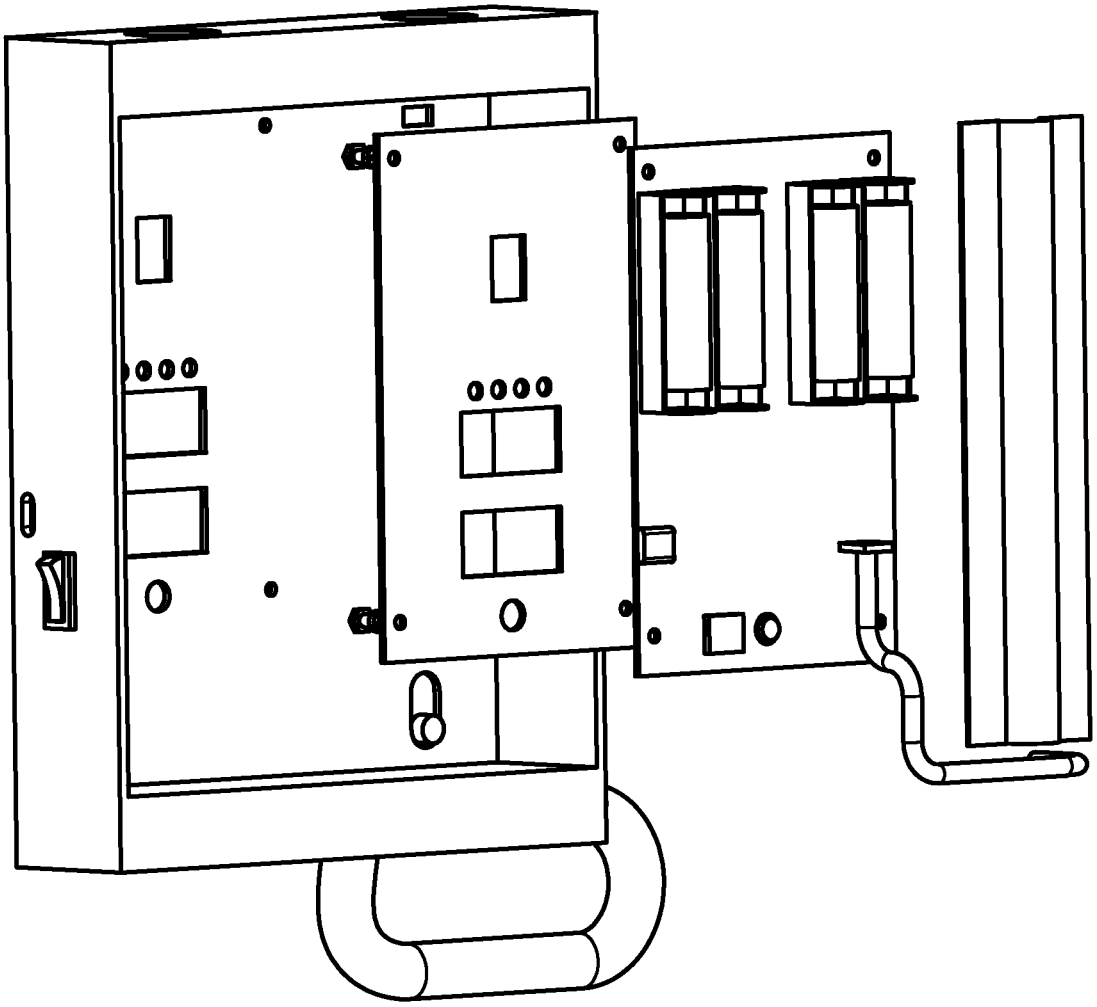
FIG. 8 is an exploded view of a Lung Trainer.

FIG. 3 is a rear view of a Lung Trainer with a back cover removed. Shown are: circuit board 1700; and, internal tubing 1800.

Figure 9A:
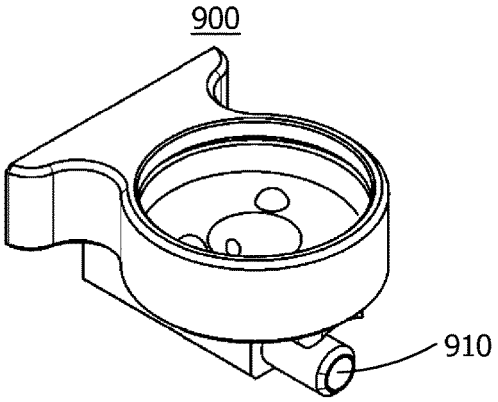
FIG. 9*a* is an isometric view of the check valve from the bottom chamber connection mount.
Figure 9B:
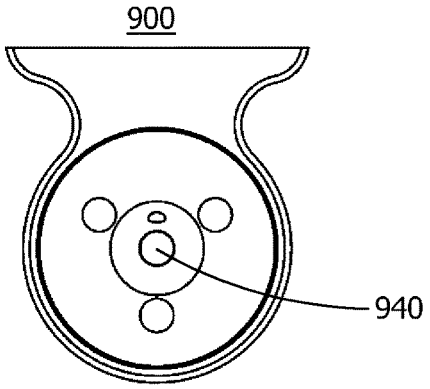
FIG. 9*b* is a top view of the check valve from the bottom chamber connection mount.
Figure 9C:
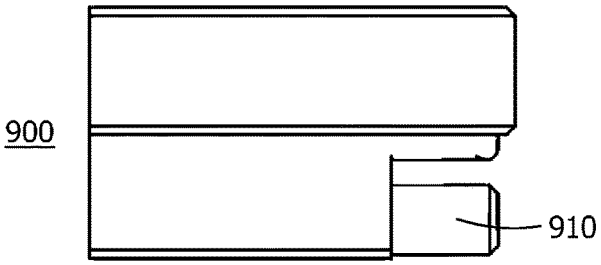
FIG. 9*c* is a left sided view of the check valve from the bottom chamber connection mount.
Figure 9D:
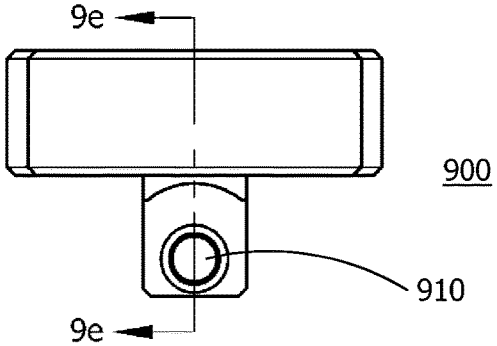
FIG. 9*d* is a front view of the check valve from the bottom chamber connection mount.
Figure 9E:
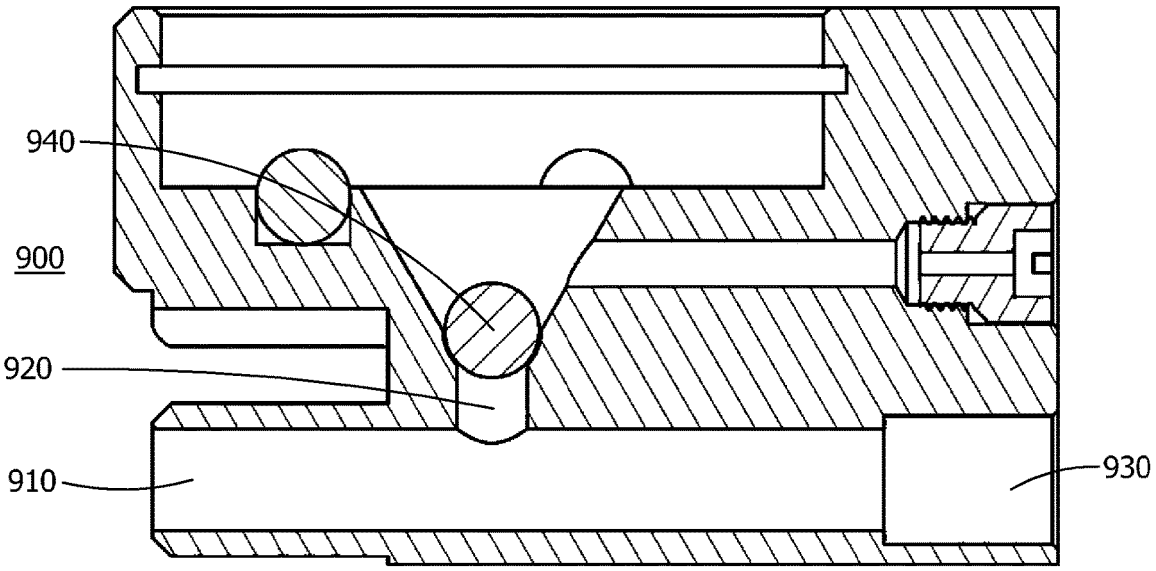
FIG. 9*e* is a cross sectional view from the right side of the check valve from the bottom chamber connection mount taken along line 9*e* shown in FIG. 9*d*.

FIGS. 9*a*-9*e* illustrate the check valve that also serves as the bottom chamber connection mount 900. FIG. 9*a* is an isometric view of the check valve from the bottom chamber connection mount. FIG. 9*b* is a top view of the check valve from the bottom chamber connection mount. FIG. 9*c* is a left sided view of the check valve from the bottom chamber connection mount. FIG. 9*d* is a front view of the check valve from the bottom chamber connection mount. FIG. 9*e* is a cross sectional view from the right side of the check valve from the bottom chamber connection mount taken along line 9*e* shown in FIG. 9*d*. Shown are: air inlet 910; outlet to processor 930; air flow exit jet 920; and bearing 940. The bottom connection mount 900 serves to connect the air inlet 910 and air flow exit jet 920 to the chamber 600 (not shown). Air flow causes the bearing 940 to lift away from a check valve orifice formed at a basin inside the bottom chamber connection mount allowing air to enter the chamber 600 (not shown) and exit from the airflow exit jet 920. However, when air flow halts the bearing rests in the basin creating a seal at the base of the check valve that prevents air from backflowing into the air inlet 910 or out through the outlet to processor 930. The output to the processor 930 from the check valve enables measurement capabilities of expanded Lung Trainer. The expanded Lung Trainer and other computer enabled Lung Trainers with virtual inserts/simulated resistance and advanced capabilities and measurement systems that include, but are not limited to:

1. Expiration Pressure in psi
2. Inspiration and Expiration flow rate with flow direction sensing.
3. Oxygen level sensing in real time
4. Carbon dioxide level sensing in real time
5. Surface electromyographic sensing of internal and external intercostal muscles for assessment of voluntary recruitment of respiratory musculature.
6. Wifi communication with external networks
7. Bluetooth and bluetooth low energy (BLE) communication with external devices and networks
8. Storage of multivariate session data over multiple tests with ability to transmit data over networks including the internet
9. Graphic display of real time session data in multiple formats
10. Localized analysis of session data with display and storage of results Complete Spirometry measurements: Pressure and flow measurement during inspiration and expiration to estimate tidal volume, inspiratory reserve volume, expiratory reserve volume and residual volume.

These allow the estimation of pulmonary capacities which include the inspiratory capacity, functional residual capacity, the vital capacity and the total lung capacity.

The measurement of volumes over time further allows calculation of the very important rate of alveolar ventilation.

Gas composition measurements during inspiration and expiration. These include calculation and display of air O2 and CO2 during resting volume and capacity measurements.

Real time measurement of Oxygen consumption in liters/minute (L/min) versus ventilation in L/min, which is a powerful lung function estimate.

Capability of calculating sports/exercise related measurements including, but not limited to VO2 max and the oxygen diffusing capacity of athletes.

Capability to use the Lung Trainer in physical and rehabilitation inpatient and outpatient clinics for rehab and recovery after lung insult such as the after-effects of Covid-19 infection or chest injury (post operative i.e. open heart or lung transplant).

Capability to display the Surface Electromyographic SEMG activity of the external intercostals and the internal intercostals. The external intercostal musculature are involved in lifting the chest cavity upward during inspiration and the internal intercostal musculature are involved in compression of the chest, forcing downward compression movement. The Lung Trainer integrates this SEMG activity and provides a visual quantitative display for clinicians and patients. This is very useful in assessing conscious awareness of respiratory muscle recruitment. This activity directly correlates with lung pressure. Thus, display of pressure and flow rate are assessed collectively along with the neurological conscious effort of motor recruitment.

Conscious motor activity (recruitment) is affected by neurologic impairment such as in the case of stroke and spinal cord injury or other brain injury to the motor centers of the brain. SEMG activity of the internal intercostals can be used to as an indicator to initiate electrical stimulation of these muscles groups, thereby initiating contraction of these muscles to implement chest compression or elevation. A visual threshold can be set whereby stimulation can be initiated to bring about muscle contraction. This can be employed in a prosthetic context whereby an impaired individual can operate their own chest muscles volitionally without having to use an external mechanical ventilator.

Figure 10A:
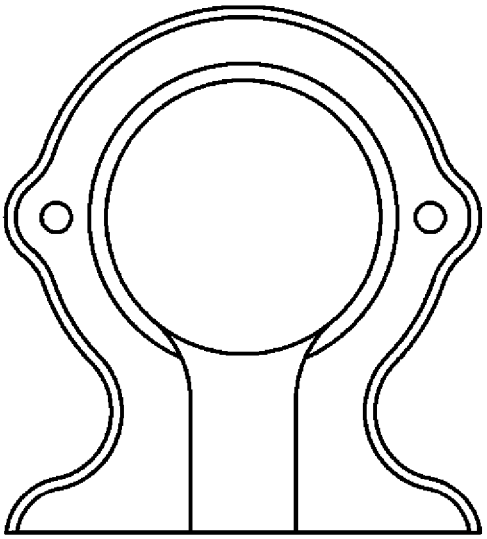
FIG. 10*a* is a bottom view of the upper chamber connection mount.
Figure 10B:
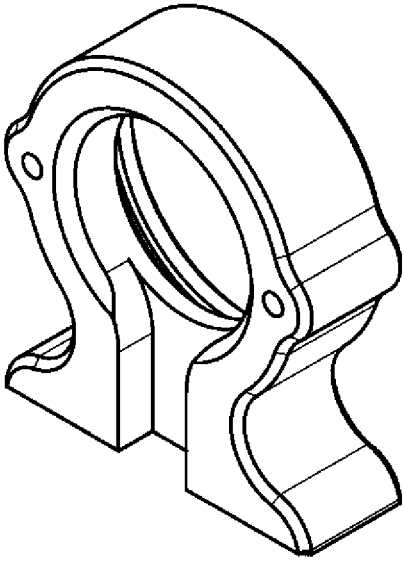
FIG. 10*b* is an isometric view of the upper chamber connection mount.
Figure 10C:
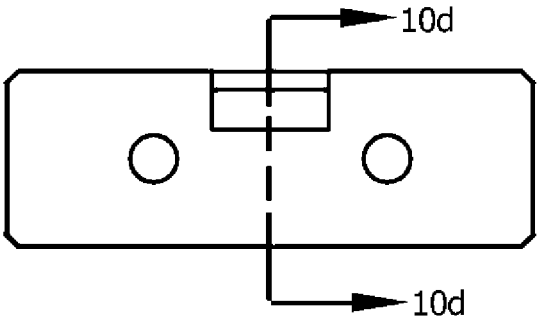
FIG. 10*c* is a front view of the upper chamber connection mount.
Figure 10D:
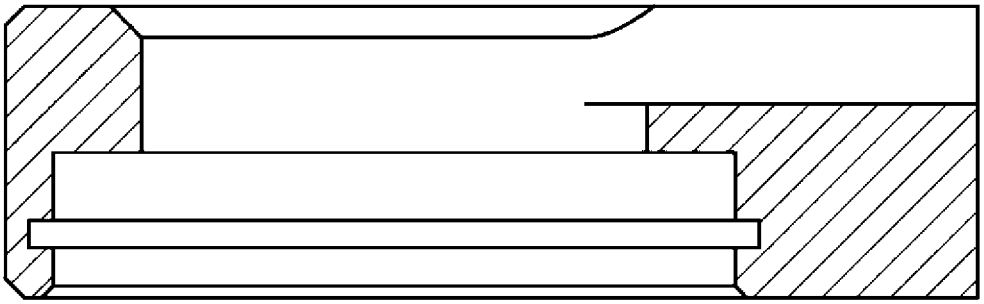
FIG. 10*d* is a cross sectional view of the upper chamber connection mount taken along line 10*d* shown in FIG. 10*c*.

FIGS. 10*a-d* are the upper chamber connection mount. FIG. 10*a* is a bottom view of the upper chamber connection mount. FIG. 10*b* is an isometric view of the upper chamber connection mount. FIG. 10*c* is a front view of the upper chamber connection mount. FIG. 10*d* is a cross sectional view of the upper chamber connection mount taken along line 10*d* shown in FIG. 10*c*. They illustrate the various dimensional features of the upper connection mount.

Figure 11:
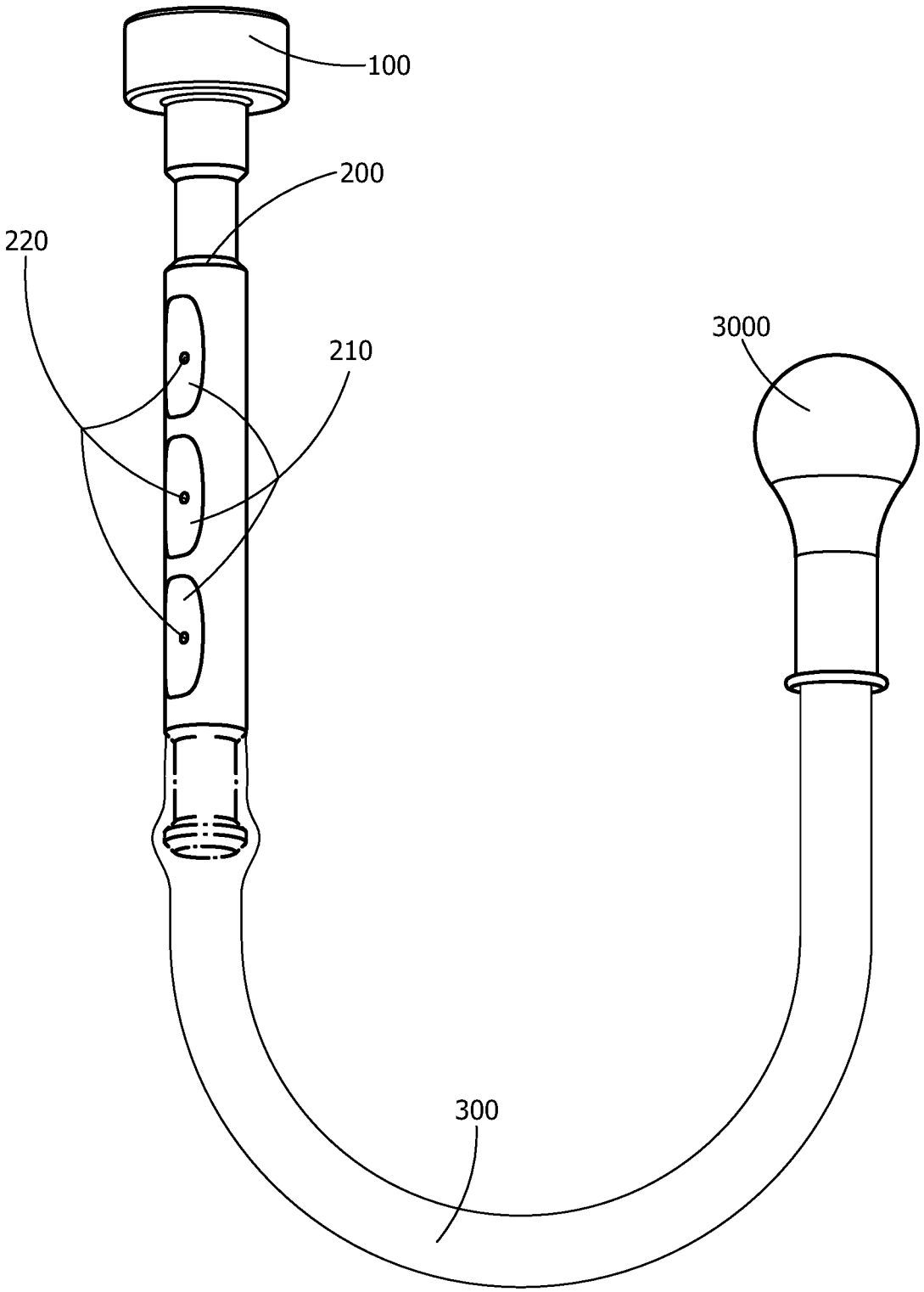
FIG. 11 is front view of an Individualized Lung Trainer.

FIG. 11 is front view of a portable Lung Trainer. FIG. 11 shows: mouthpiece 100; regulator 200; regulator finger positioner 210; orifice 220; tube 300 and balloon 3000. The mouthpiece 100 and regulator 200 are connectively associated with the tube 300 into the individualized disposable or low-cost lung trainer tool. One embodiment of this tool is wholly integrated so that all such parts form a unitary piece. However, it is generally preferable that each part be separable. Although lung trainers made with this method are highly portable and may be designed of low-cost plastic to be disposable they may also be easily reused and sanitized by cleaning the parts and discarding of the balloon. Generally, these portable lung trainer tools are recommended to be manufactured and sold as kits with more than one balloon. This allows for greater use and function. Some kits provide balloons of different/varying densities and resistances to enable greater variance in exercise and training. The present kits generally use balloons with less that 1 psi resistance. 0.25 PSI-0.75 PSI being a presently preferred range. A kit may provide a variety of balloons with varying colors or markings that enable easier selection and indication of the back pressure created by the selected balloon.

Figure 12:
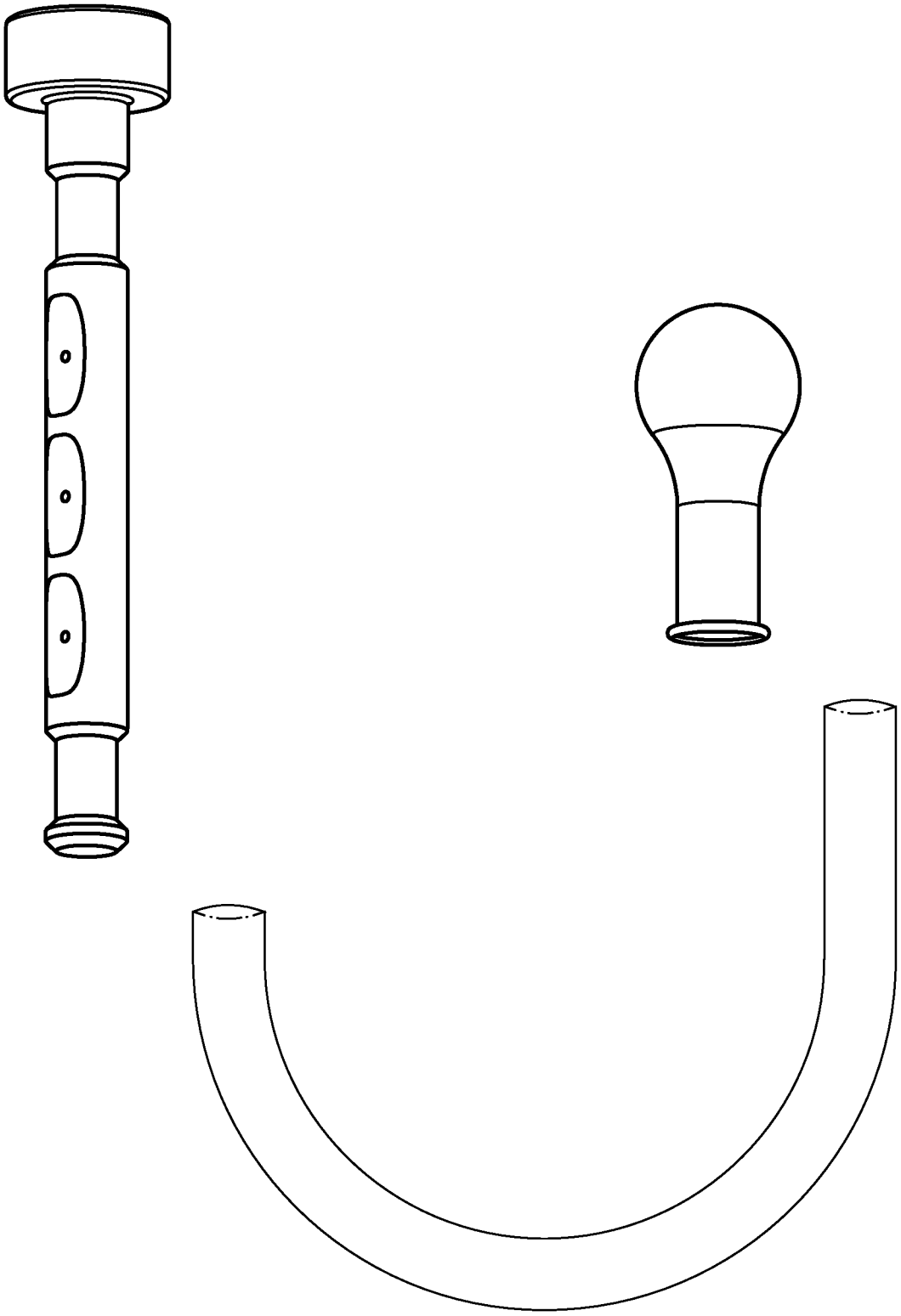
FIG. 12 is disconnected view of an Individualized Lung Trainer.

FIG. 12 is disconnected view of an Individualized Lung Trainer.

Figure 13:
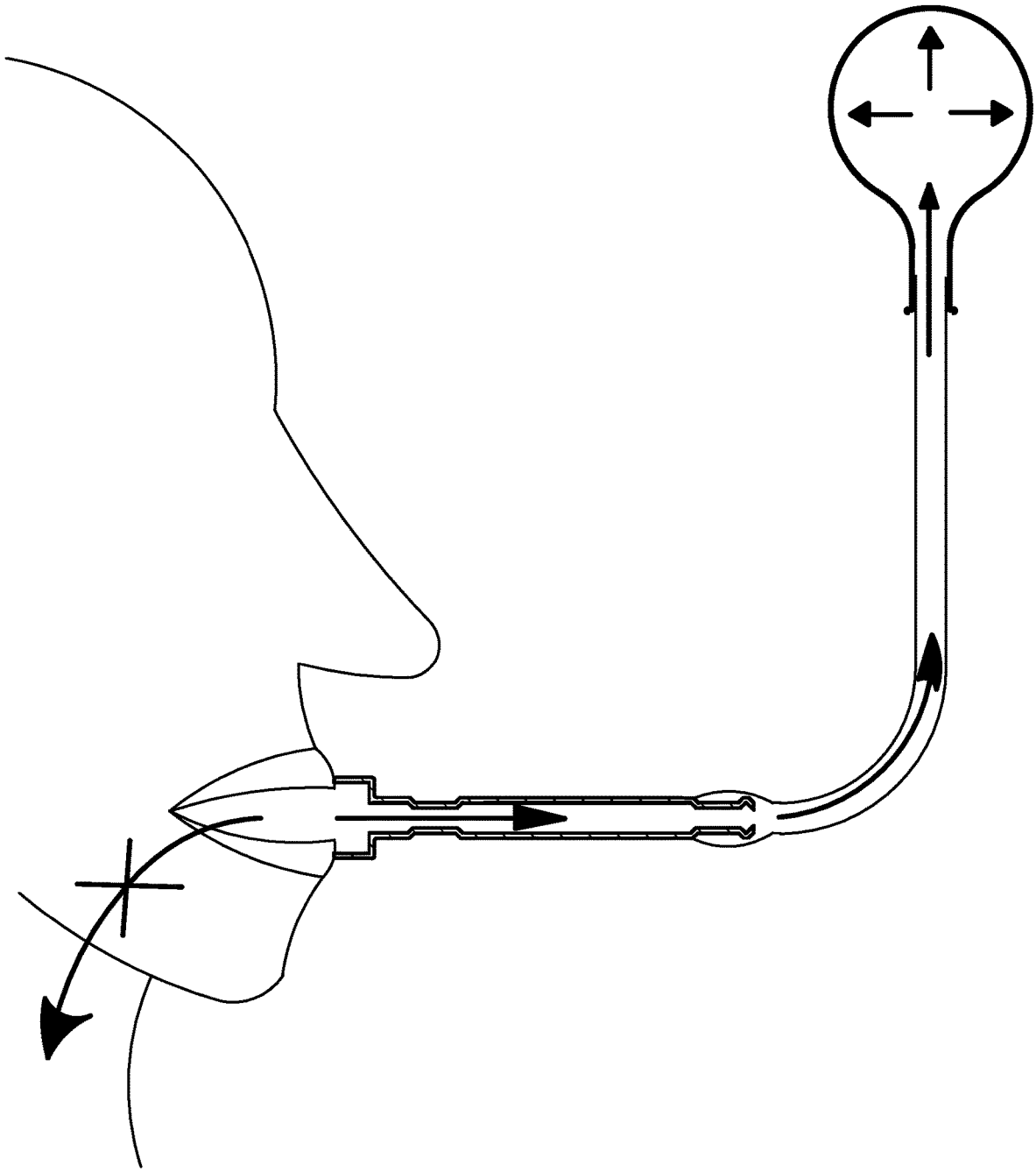
FIG. 13 illustrates the use of an Individualized Lung Trainer.

FIG. 13 illustrates the use of an Individualized Lung Trainer.

Figure 14:
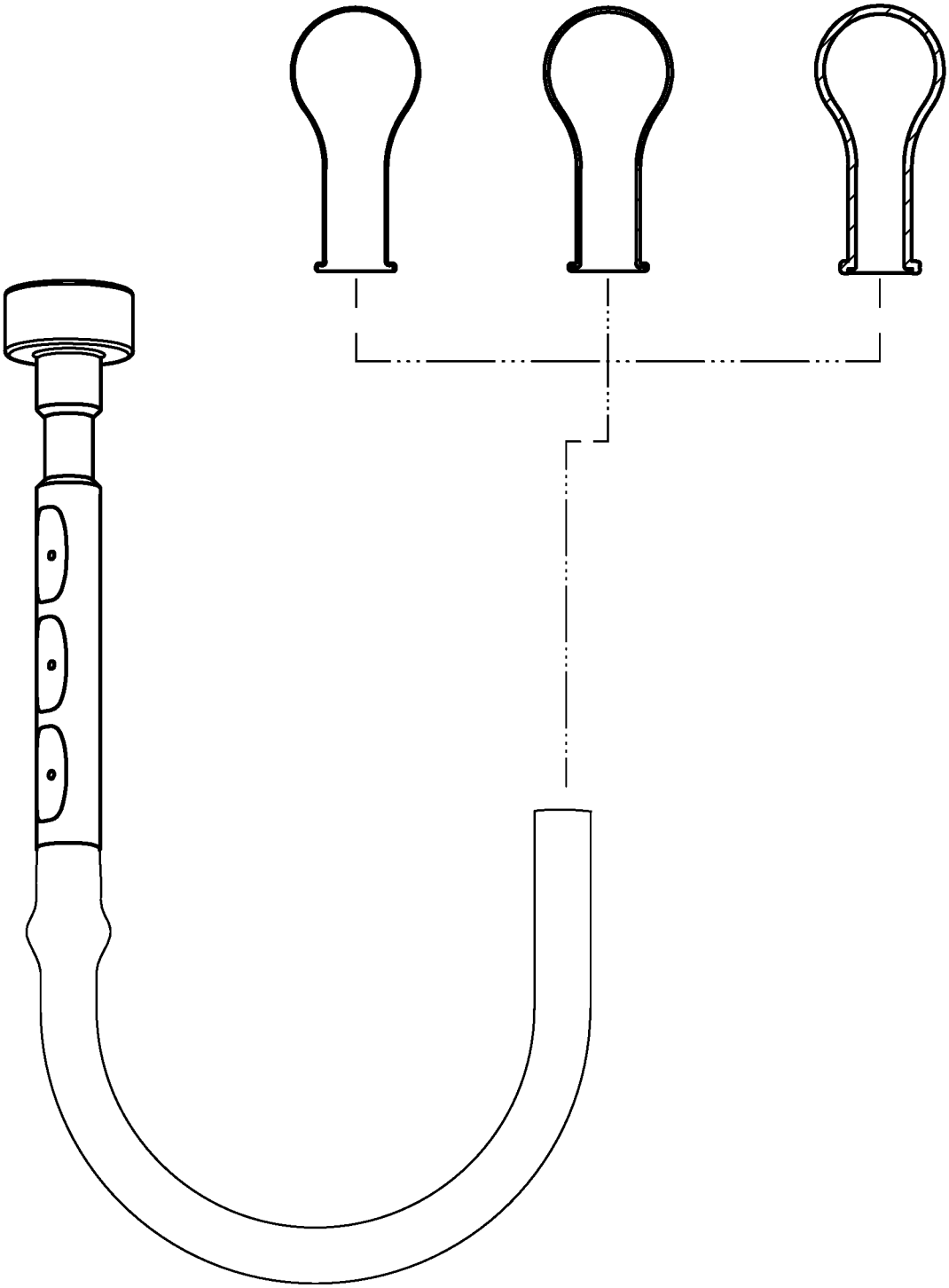
FIG. 14 illustrates a selection of balloons in an Individualized Lung Trainer Kit.

FIG. 14 illustrates a selection of balloons in an Individualized Lung Trainer Kit.

Figure 15:
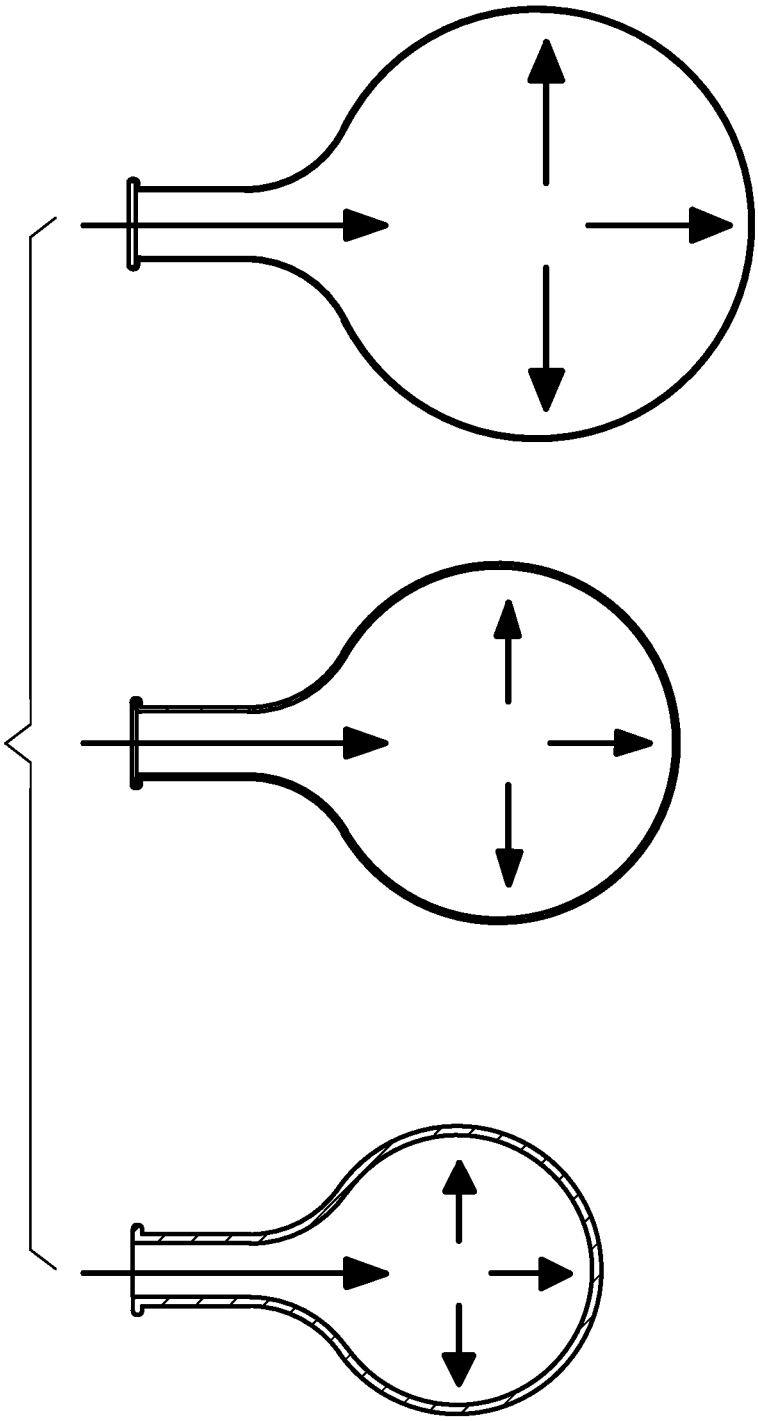
FIG. 15 illustrates alternative balloons in an Individualized Lung Trainer Kit based upon various forms of resistance.

FIG. 15 illustrates alternative balloons in the kit based upon various forms of resistance. For instance, a Lung Trainer Kit may provide balloons ranging from 0.1-4 PSI. The same breath pressure stretches each balloon differently.

Figure 16:
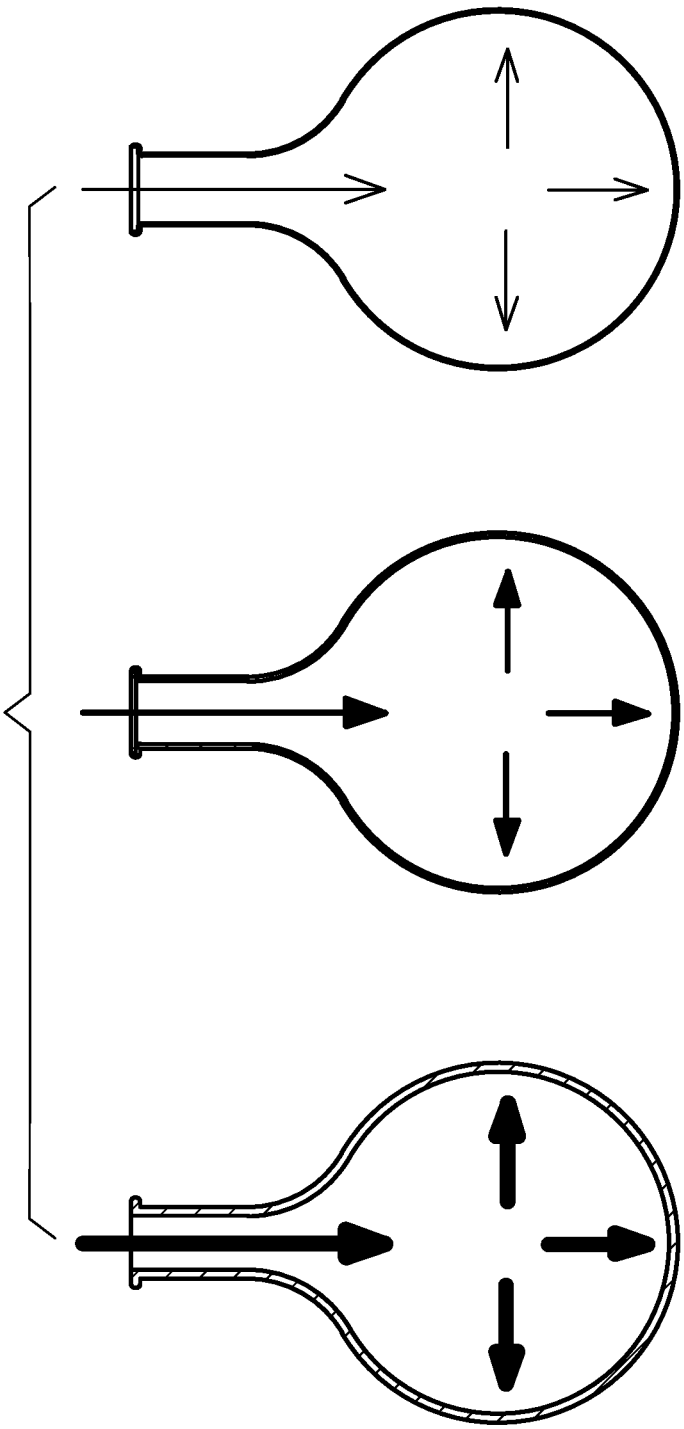
FIG. 16 illustrates the expansion and back pressure from balloons selected in an Individualized Lung Trainer Kit.
Figure 17A:
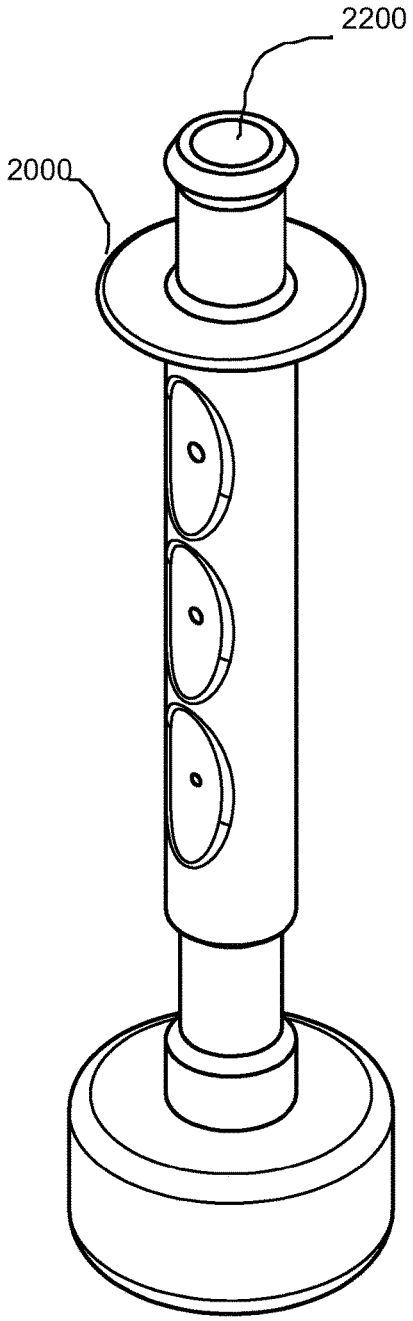
FIG. 17*a* is a top front side perspective view of an Individualized Lung Trainer.
Figure 17B:
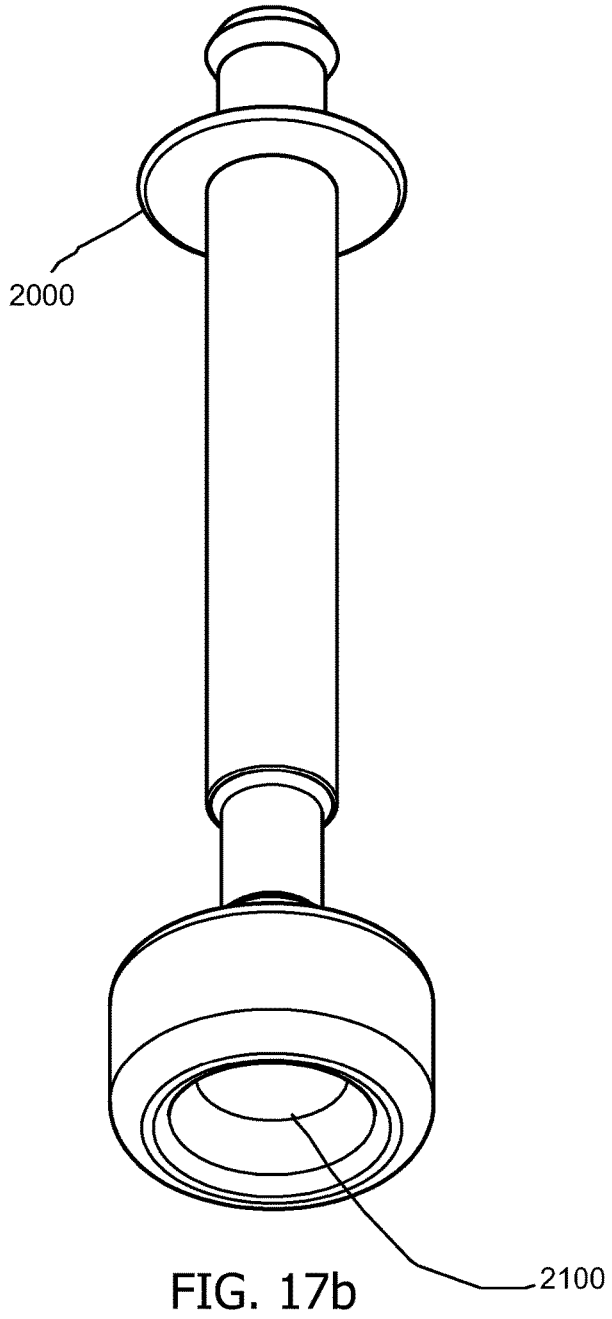
FIG. 17*b* is a bottom rear side perspective view of an Individualized Lung Trainer.
Figure 18A:
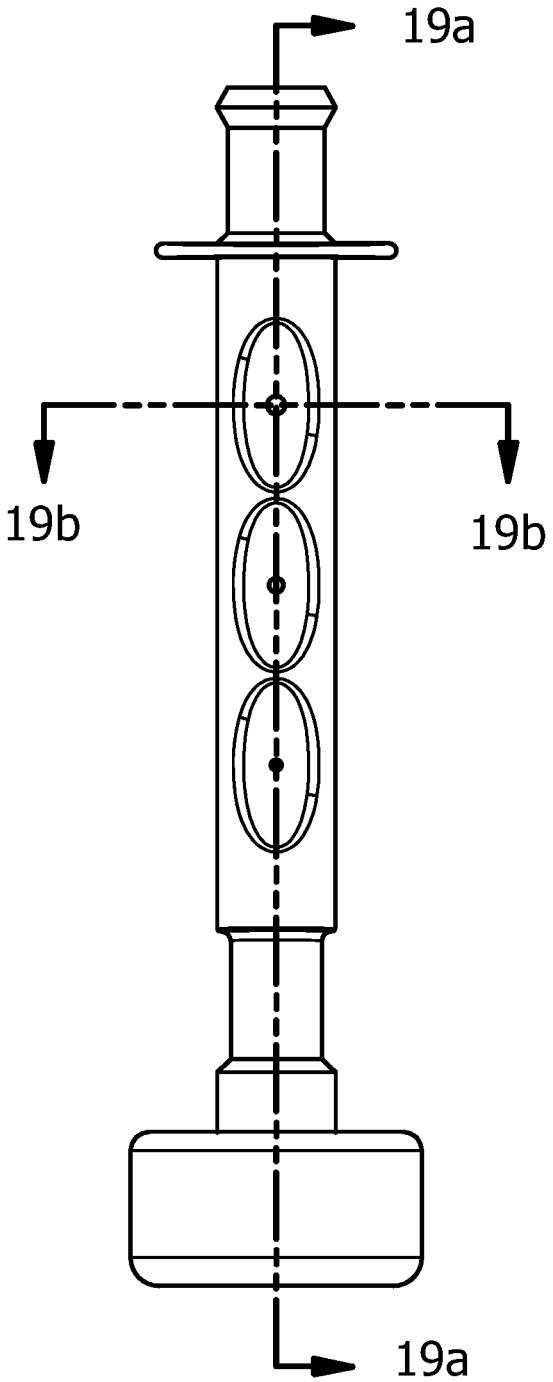
FIG. 18*a* is a front plan view of an Individualized Lung Trainer.
Figure 18B:
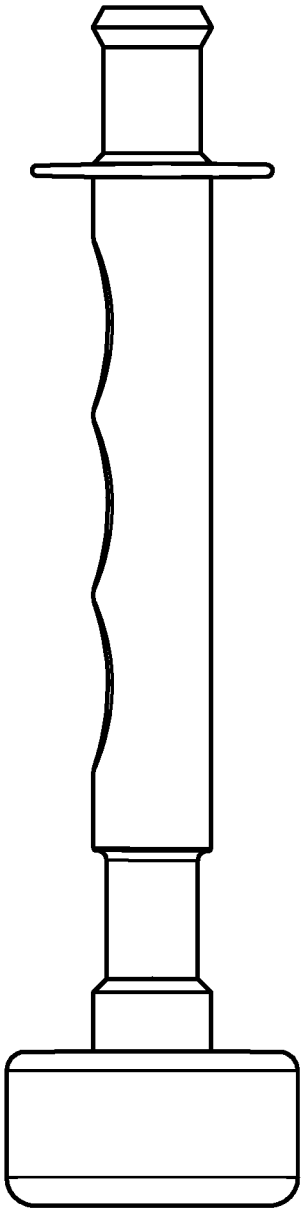
FIG. 18*b* is a side plan view of an Individualized Lung Trainer.
Figure 19A:
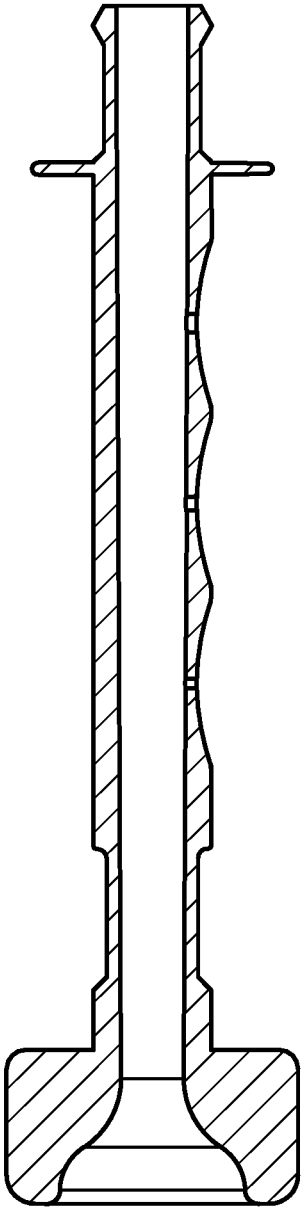
FIG. 19*a* is a sectional view of an Individualized Lung Trainer depicted in FIG. 18*a* along line 19*a*.
Figure 19B:
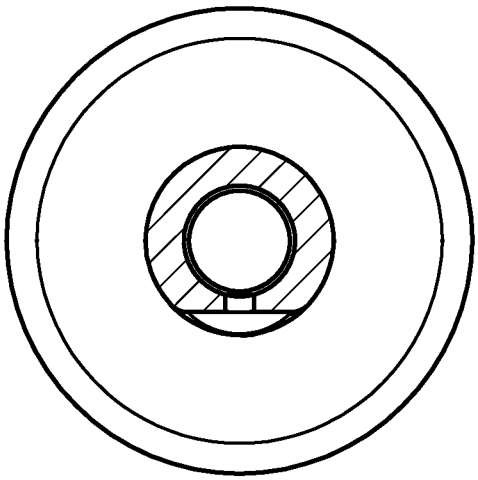
FIG. 19*b* is a front view of an Individualized Lung Trainer depicted in FIG. 18*a* along line 19*b*.
Figure 20A:
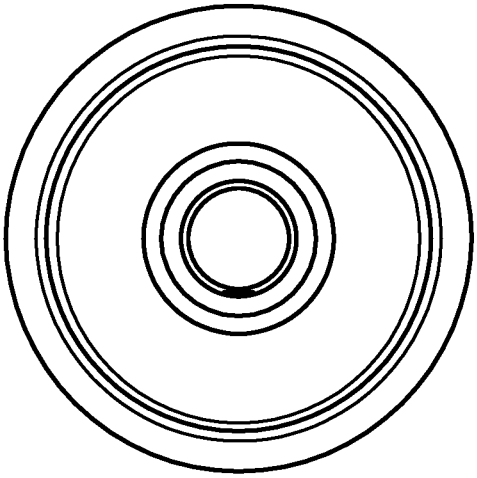
FIG. 20*a* is a top view of an Individualized Lung Trainer.
Figure 20B:
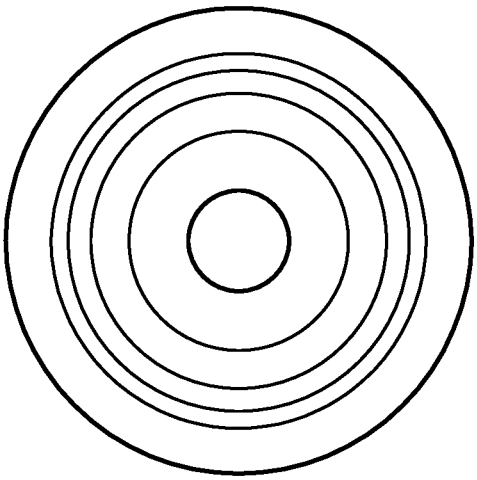
FIG. 20*b* is bottom view of an Individualized Lung Trainer.

FIG. 16 illustrates the expansion and back pressure from balloons selected in an Individualized Lung Trainer Kit. FIG. 16 illustrates that different strength breaths are needed for the same stretch between each balloon type.

The Lung Trainer devices are based on the fundamental that all wind instruments and voice operate on an equation of air pressure and air flow. By focusing on the correct equation for each instrument, a user can improve breathing at an accelerated rate. The following are some of the best methods of using lung trainers for the needs of music students, to train lungs, exercise diaphragm and core muscles, inflate balloons, move weighted inserts and alter and measure pressure and airflow within a lung trainer.

Lung trainers are designed to be used for instruction, improvement and practicing duration, phrasing, articulation markings, dynamics, entrances, and other music related drills. Several example embodiments and methods follow for some of the best practiced exercises for users as well as methods of analyzing data and utilizing 'crossover challenge' exercises.

The Crossover Challenge exercises are included to reinforce proper breathing techniques on the instrument (voice) when demonstrating skills on the Lung Trainer is achieved. Various methods using lung training devices to train lungs, exercise diaphragm and core muscles, inflate balloons, move weighted inserts and alter and measure pressure and airflow within a Lung Trainer.

FIGS. 17-20 illustrate one embodiment of an individualized lung trainer. In some embodiments the orifices of this individualized lung trainer are preferred to be about 19.05 mm apart from center, but this may vary. In some embodiments the orifices range from approximately 1.1 mm-1.9 m in diameter. In some embodiments the device weighs approximately 21.1 g. In some embodiments with three orifices the orifices measure approximately 1.1 mm, 1.5 mm, and 1.9 mm. In some embodiments the internal air channel should be about 7.6 mm and the securing ring 2000 should be approximately 17 mm from the end. In some embodiments, the securing ring 2000 should be about 1.5 mm thick and about 25.4 mm in diameter. The total length of the regulator in some embodiments is about 126.8 mm from end to end, wherein the opening on the mouth end of the regulator 2100 is approximately 19.5 mm and tappers to the 7.6 mm internal air channel on the end for connecting the balloons 2200. These measurements have been discovered by the inventors to optimize the efficiency of intended purpose of the invention while providing excellent comfort in use and portability. These measurements are approximate and may range by plus or minus depending on the intended purpose and capability and precision of the manufacturing processes.

FIG. 21 and FIG. 22 are tables that shows the level of specific training when comparing conventional breathing exercises to the level of exercises that can be utilized on a Lung Trainer. A Lung Trainer allows each user to customize their training to the instrument that he/she uses.

That is, a Lung Trainer offers an Individualized Instructional Breathing Plan as Generic Breathing Exercises for ALL users. Using a Lung Trainer cuts the time drastically to teach users how to breath by using the PSI/air flow specific to the targeted instrument, wind or voice.

Lung Trainers can teach breathing skills in a fraction of the time versus conventional teaching. Below is a comparison of some of the common generic breathing exercises compared to training with a Lung Trainer.

Note—The Lung Trainer referred to in this comparison is the LT MD3 or LT Classic. The LT MD3 and Classic come standard with 3 weighted inserts and 3-hole air regulator. The MD3 uses the LT Advisor, the PSI LED lights to adjust pressure and breathing, resting, and set counter digital displays. Similar results can be achieved with IBA.

Breathing Pressure in Music

In music, both air pressure (resistance) and air flow are key ingredients in the development of an exercise routine that will bring the student to peak performance in his/her area of study. Below, you will find an instrument chart and the air pressure that is associated with each. The Lung Trainer provides the essential ingredients to the student to combine the resistance while specifically targeting the air flow.

Note: In the examples provided, each insert is specifically engineered to represent 0.5 PSI. When using any Lung Trainer with the LT Advisor or Advisor Plus, simply keep the exhalation point to maintain only the green LED. For 1 PSI, maintain the yellow LED and for 1.5, maintain the red LED.

On the LT Classic, maintain each insert in the middle of the chamber. (e.g. 1 insert=0.5 PSI). Keeping it steady in the middle of the chamber will focus your exercise to 0.5 PSI. (2 inserts=1.0 psi, 3 inserts=1.5 psi).

The Lung Trainer utilizes next generation technology to target specific air flow and resistance (pressure). Note: By releasing the holes on the air regulator, the user releases air, making it possible for the user to increase air flow. However, releasing air will not increase PSI. This is important as the user's instrument may use increased air flow but little resistance or air pressure.

Learning to 'Belly Breathe'

This exercise helps users realize the 'feeling' of breathing from the diaphragm. It incorporates 'muscle memory', as part of their breathing curriculum.

1. Load 1 insert into chamber or use IBA.
2. Use one hand to hold mouthpiece, with smallest hole open.
3. Place other hand on stomach (belly).
4. Inhale for 4 counts. Feel the stomach (belly) area move out during each count
of the inhalation.
5. Hold breath for 4 counts.
6. Exhale for 4 counts. Feel the stomach (belly) release during each count of the exhalation.
7. Focus on the rise and fall of the diaphragm during each part of this exercise.
8. Repeat steps 4-7 until comfortable with understanding 'belly breathing'.
9. Try this exercise on an instrument to develop better understanding of correct breathing.

The Baseline Duration Exercise

One of the best indicators of success when using the Lung Trainer Breathing System is to determine a baseline breathing mark for every user. Through consistent use of a Lung Trainer, duration can be used as an indicator of success. Each user/student can have his/her personal developmental guide or the teacher can maintain a class grid, like the one in FIG. 23.

Adjusting air flow and pressure for wind instruments and voice

It should be noted that one of the primary advantages of the Lung Trainer is that it can be used to replicate the breathing used by all instruments, including voice. All wind instruments, and voice, use a specific amount of air pressure and air flow, when perfectly played. FIG. 24 is a table of instruments and variables/equations to use when developing exercise routines.

Mouthpiece/Lip Placement

The mouthpiece for the Lung Trainer has been specifically engineered to assist the user to use fast and focused air. It uses a small aperture, reinforcing production of fast air for conducting the exercising appropriately.

Lip placement-Users should be careful to not be confused by the shape of the mouthpiece unit. It is NOT recommended that any embouchure be used to produce exhalation. The technology of the mouthpiece was expressly engineered that no embouchure was needed for breathing developmental exercising. It is specifically designed to provide perfect breathing instruction for any user. Moving from the Lung Trainer to instrument is generally seamless with almost 100% physical transfer between exercise and playing execution.

When setting up for an exercise:

1. Place the mouthpiece between the thumb and the first finger.
2. Bring the mouthpiece to flat, not puckered lips, using a slightly open mouth.
3. When exhaling, a user should seal the lips to the mouthpiece, ensuring no air escapes around mouth.
4. When exhaling during the exercise, a user should not puff the cheeks.
5. TUBA players—For instruments with large mouthpieces, like the tuba, it is recommended that the user places the lips around the mouthpiece. This will provide a more realistic feeling of playing the instrument.

The IBA/IBA mini (Individual Breathing Assistant)

The IBA and IBA mini are stand alone, portable breathing development devices that can be used by one user or in a group/class setting, with a high level of effectiveness. The holes on the air regulator manage that amount of air flow used for each exercise.

Generally, the preferred balloon creates an air pressure of approximately 0.5 psi. This is the pressure used to engage the core breathing muscles or diaphragm. It is also the pressure used by many wind instruments, including voice. Suitable balloons will generally range+/−0.1 of 0.5 psi. However, approximately 25, 75, 1, 1.25, 1.5, 2 psi, etc. balloons may also be used.

Assembling the Iba

1. On one end of the IBA, place the air tube on the mouthpiece/air regulator.
2. On the other end of the air tube, place the balloon. During the exercise, slightly pinch the balloon end of air tube to ensure that it does not blow off.
3. On the IBA mini, place the balloon directly on the attachment end.
4. Once the balloon is removed, the IBA can be placed directly on the Lung Trainer. For the mini, the attachment must be removed.

Exercises can be performed on the IBA. IBA mini, or the Lung Trainer.

The IBA v MD3

How to use air flow and air pressure to advantage

Examples of high air flow instruments include flute, clarinet, tuba, and voice. By opening one or more holes on the air regulator, the student can use as much, or as little air flow as needed. However, the air pressure will remain consistent (0.5 psi), therefore, there is less concern for students (especially, voice) using too much tightness or pressure in the neck area. And because the mouthpiece uses a small aperture, the student learns to use fast and focused air, almost immediately. Great for intonation drills.

Instruments that use high pressure, such as trumpet, oboe, and French horn, would use less holes or no open holes. However, the IBA uses only 0.5 psi, therefore, for increasing pressure exercises (e.g., range) the student would need to work with the Lung Trainer MD3.

The Iba in an Ensemble Setting

To use the IBA in an ensemble setting, the instructor must first determine the goal. The IBA can be used as a generic breathing exerciser, with all students enabling the same open holes or can be differentiated, where every section uses a specific combination for their instrument.

A simple, yet very effective duration exercise, using the IBA can be found below.

Set-up-IBA with attached balloon, set to the smallest hole open.

Exercise

1. Inhale for 4 counts
2. Hold for 4 counts
3. Exhale for 8 counts
4. Deflate balloon into shoulder for 4 counts
5. Repeat The instructor or coach can modify each part of the exercise to best meet the needs of the user. (Refer to air flow/air pressure equations for musicians, athletes, and general breathing enthusiasts.

When first beginning an exercise regimen using the Lung Trainer Breathing Developmental System, it is suggested that the baseline breathing exhalation level is determined. This is best calculated by using the Duration exercise, found below.

1. Turn on Lung Trainer.
2. Load 1 insert is in chamber or use IBA.
3. Lift the finger off the smallest hole.
4. Take a deep breath.
5. Exhale into the air tube for as long as comfortable, making sure the yellow LED is maintained.
6. Write down your exhalation score.

This exercise will provide you a breathing score to help you understand your breathing progress.

4×4 Square Exercise

This is an outstanding exercise to assist in the development of perfect breathing form.

Exercise

Each student should have the IBA mini ready with the balloon attached at the end. See picture below (right)

1. Lift 1 finger off the smallest hole.
2. Load 1 insert in the chamber or use IBA.
3. Inhale for 4 counts.
4. Hold breath for 4 counts.
5. Exhale for 4 counts
6. Release for 4 counts
7. Repeat exercise for 5 sets/repetitions. (steps 3-6)

Modified Duration Techniques (Long Tones)

Using duration exercises will build longer breathing endurance as well as develop better strength in the core region (diaphragm).

Exercise

1. Lift fingers off 0, 1, 2, or ALL holes from air regulator.
2. Load 1, 2, or 3 inserts in the chamber or use IBA.
3. Begin by inhaling for 4 counts, then 2, then 1.
4. Exhale into air tube for as long as comfortable.
5. Release for 4 counts Repeat steps 3 and 4 for 5 sets/repetitions CROSSOVER CHALLENGE—Complete this exercise on an instrument, using a neutral tone (e.g. Eb). Begin with a soft dynamic, gradually increasing level then decrease level to the original soft dynamic.

Accents

This exercise mirrors the breathing air flow and pressure used to simulate playing or singing accents in music. Attention should be focused on the initial exhalation attack.

Exercise

1. Lift 3 fingers off the air regulators.

Load as many inserts in the chamber as comfortable and appropriate for the targeted instrument or use IBA.

3. Inhale for 1 count.

4. Exhale aggressively for 1 count. (like playing or singing an accent)

5. Repeat exercise until confident with skill.

6. Try on instrument or voice.

TIP: Try exhaling for 2, 4, + counts.

CROSSOVER CHALLENGE: Try the exercise on instrument or voice.

Instruments can use a unified concert pitch or music. Voice can use a neutral syllable (e.g. 'ta') or music.

The Crescendo

This exercise is specific to increasing from minimum sound to larger sound in musicians or duplicating breathing for incremental breathing stress, for example running up a hill for runners.

1. Lift finger from large hole on air regulator.

2. Load 1 insert in the chamber or use IBA mini.

3. Music-inhale 1 count.

4. Exhale with increasing air flow for 8 counts, beginning with yellow LED gradually increasing to red and blue or LED 3 and LED 4.

5. Repeat steps 3 and 4 for 5 sets/repetitions

Music Entrances

This exercise is best realized when using a teacher or other student to direct the user to begin at a targeted time (e.g. beginning of music, phrase, etc.

1. Load 1 or 2 inserts into chamber or use IBA.

2. The director will give a 1, 2, 3, or 4 count prep.

3. The user will breathe as necessary during the prep and exhale into the mouthpiece, when directed.

4. The exhalation strength will be determined by the dynamic level of the entrance.

5. Repeat until a desired result has been achieved.

6. Try the exercise on instrument or voice.

1. Load 1 or 2 inserts into chamber or use IBA.

2. The director will give a 1, 2, 3, or 4 count prep.

3. The user will breathe as necessary during the prep and exhale into the mouthpiece or sing, when directed.

4. The exhalation strength will be determined by the dynamic level of the entrance.

5. Repeat until a desired result has been achieved.

6. Try the exercise on instrument or voice.

CROSSOVER CHALLENGE-Try playing or singing on a neutral pitch, then try with the music.

Phrasing/Cycles

This exercise, when properly executed, provides users the ability to focus pure breathing skills with phrasing for music (e.g. band, chorus) or athletic focus (e.g. running, swimming, MMA)

1. Determine the number of counts or seconds needed. In music, this could be 8 or 16 counts. In sports, this could be x seconds)

2. Load 1 insert into chamber or use IBA.

3. Inhale for 1, 2 or 4 counts. Determine by goal.

4. Music-inhale for 1 count. Sports-inhale for 2 or 4 counts.

5. Exhale. Music-exhale for 8 counts. Sports-exhale to match inhale time.

6. Repeat for minimum of 4 sets/repetitions.

Crossover Challenge

Prepare the instrument/voice

Use the phrase that is presented in the music.

1. Inhale for 1 count.

2. Play/sing the targeted phrase.

3. All students should focus on tone development.

Breathing a Song

The recommend configuration of a lung trainer when using this exercise to

This exercise is best realized when using a teacher or other student to direct the user to begin at a targeted time (e.g. beginning of music, phrase, etc.)

1. Load 1 or 2 inserts into chamber or use IBA

2. The director will give a 1, 2, 3, or 4 count prep

3. The user will breathe as necessary during the prep and exhale into the mouthpiece, when directed.

4. The exhalation strength will be determined by the dynamic level of the entrance.

5. Repeat until a desired result has been achieved.

6. Try the exercise on instrument or voice.

No Pain, No Gain', the Marine (Dynamic Contrast)

This exercise incorporates using a 'weightlifting' concept to promote strengthening of the core.

Steps 3-10 must be done using 1 breath, only.

Exhale total-15 seconds inhale total-10 seconds

Exercise

1. Load up to 2 inserts in the chamber or what is comfortable. (Or use IBA mini)

2. Fully inhale for 4 counts.

3. Exhale for 4 counts, all holes closed

4. After 4 counts, lift the first finger.

5. After another 4 seconds, lift the first and second fingers.

6. After another 4 seconds, lift ALL fingers.

7. Rest for 4 seconds, release air into shoulder.

8. Repeat steps 2-7 for 4+ sets.

Power Exercise

This exercise promotes needed strength in the core regional, with focus on the diaphragm. It is perfect for users who need practice with strong back pressure.

1. Lift 0, 1, 2, or 3 fingers off the air regulator.

2. Load 2 or 3 inserts in the chamber. (not available for IBA mini)

3. Inhale for 4 counts.

4. Hold breath for 4 counts.

5. Exhale for minimum of 1 count. (more when comfortable)

6. Repeat exercise for 5 sets/repetitions. (steps 3-5)

Adding Range

One of the hardest concepts to achieve for brass players is to extend range. While lip strength is extremely important, having enough exhalation is critical. This exercise reinforces the breathing framework for upper register playing.

This exercise is specific to brass players or users who need more focused air to reach upper range for their instrument. Think of the exercise as working mid-range to high range in same repetition.

1. Lift 1 or more fingers on regulator.

2. Load 1 or 2 inserts in the chamber. (not available for IBA)

3. Inhale for 2 counts.

4. Exhale for 2 counts maintaining yellow LED, then 6 counts at red/blue LED.

5. Repeat steps 3 and 4 for 5

CROSSOVER CHALLENGE. For brass players-play the 5th of a scale, then play the tonic or 8th of a scale. For example, G-C, A-D, etc.

The Crossover Breathing System

One of the biggest obstacles to achieving better breathing for music students is their non-ability to transfer breathing techniques from exercise to real life performance. The Lung Trainer Breathing Development Program begins with guiding students to breath in small cycles, increase to larger cycles and use correct techniques for music articulations and other music techniques.

The Lung Trainer and the IBA can replicate breathing foundations for wind instruments and voice. As students progress with breathing techniques, the teacher can guide students to use the same breathing fundamentals achieved by the Lung Trainer and IBA and 'crossover' to using the same strategies while playing or singing.

Crossover exercises are achieved by using the instrument or voice as opposed to using the Lung Trainer. By focusing on the exact 'muscle memory', the student will realize success. Crossover exercises should be incorporated in a group setting, using the Individual Breathing Assistant (IBA), however, used in conjunction with the MD3, can lead students to significant results.

Needs: Iba and Instrument/Voice

Single Dynamic Long Tones

Long tones exercises will build longer breathing execution as well as develop better strength in the core region (including diaphragm). Long tones will also significantly improve tone development.

1. Lift fingers off of 0, 1, 2, or ALL holes from air regulator.
2. Load 1, 2, or 3 inserts in the chamber or use IBA.
3. Begin by inhaling for 4 counts, then 2, then 1.
4. Release air for 4 counts.
5. Exhale into air tube for 8, 12, and 16 counts.

Repeat steps 3 and 4 for 5 sets/repetitions

Prepare the instrument/voice

Use a common note, for instance, concert Eb.

1. Inhale for 4 counts.
2. Play/sing for 8 counts
3. As students play instruments, focus on tone development as well as breathing strength The Crossover Phrase Breathing development of multiple counts in one breath Needs: IBA and Instrument/Voice Music phrases played well provide the listener music interpretation and beauty. Phrase length development is important to musical expression.

1. Lift fingers off 0, 1, 2, or ALL holes from air regulator (determined by instrument).
2. Load 1, 2, or 3 inserts in the chamber (determined by instrument) or use IBA.
3. Begin by inhaling for 4 counts, then 2, then 1.
4. Release air for 4 counts.
5. Exhale into air tube for 8, 12, and 16 counts.

Repeat steps 3 and 4 for 5 sets/repetitions

Crossover Challenge

Prepare the instrument/voice

Use a common note, for instance, concert Eb.

1. Inhale for 4 counts.
2. Play/sing for 8 counts
3. As students play instruments, focus on tone development as well as breathing strength.

The Crossover Challenge Crescendo

Needs: IBA and Instrument/Voice

Dynamic Level Change Exercise

Crescendo exercises will develop students' awareness of moving from soft to loud and loud to soft dynamic levels.

1. Lift fingers off 1 hole from air regulator.
2. Load 1, 2, or 3 inserts in the chamber (determined by instrument) or use IBA.
3. Begin by inhaling for 1 count.
4. Exhale into air tube for 8, 12, and 16 counts, starting at soft and moving to loud, by increasing air flow.

Repeat steps 3 and 4 for 5 sets/repetitions

Crossover Challenge

Prepare the instrument/voice

Use a common note, for instance, concert Eb. Advance to breathing followed by introducing current music selection.

1. Inhale for 4 counts.
2. Play/sing for 8 counts
3. As students play instruments, focus on tone development as well as breathing strength.

The Crossover Entrance

Needs: IBA/MD3 and Instrument/Voice

Playing a synchronized entrance on time is critical to successful playing and singing of a music piece.

1. Lift fingers off the smallest hole from air regulator.
2. Load 1 insert in the chamber or use the IBA.
3. Begin by inhaling for playing an entrance.
4. Watch director and initiate exhalation on downbeat.
5. The insert should lift or balloon should expand on downbeat
6. For notes requiring high pressure or air flow, the MD3 may be needed.

Repeat steps 3 and 4 for 5 sets/repetitions

The Crossover Challenge

Prepare the instrument/voice

Use the note that is presented in the music.

1. Inhale, as appropriate.
2. Play/sing on downbeat,
3. As students play instruments, focus on tone development as well as breathing strength.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A lung training method comprising:

selecting a balloon from a selection of balloons connecting the selected balloon to a regulator, the regulator further comprising:

a mouthpiece; and, one or more regulator orifices wherein the selected balloon is connected to the regulator with a tube.

2. A lung training method comprising:

selecting a balloon from a selection of balloons connecting the selected balloon to a regulator, the regulator further comprising:

a mouthpiece; and, one or more regulator orifices placing the regulator to the lips of a user, the user then performing the following steps:

inhaling for 4 counts holding breath for 4 counts;

exhaling for 4 counts; and, releasing the regulator from the lips for 4 counts.

3. The lung training method of claim 2 further comprising sealing of the one or more of the regulator orifices.

* * * * *